US011835270B1

(12) United States Patent
Vaisman et al.

(10) Patent No.: US 11,835,270 B1
(45) Date of Patent: Dec. 5, 2023

(54) THERMAL MANAGEMENT SYSTEMS

(71) Applicant: Booz Allen Hamilton Inc., McLean, VA (US)

(72) Inventors: Igor Vaisman, Carmel, IN (US); Joshua Peters, Knoxville, TN (US); Martin Seifert, West Simsbury, CT (US)

(73) Assignee: Booz Allen Hamilton Inc., McLean, VA (US)

( * ) Notice: Subject to any disclaimer, the term of this patent is extended or adjusted under 35 U.S.C. 154(b) by 87 days.

(21) Appl. No.: 16/448,271

(22) Filed: Jun. 21, 2019

Related U.S. Application Data

(60) Provisional application No. 62/689,034, filed on Jun. 22, 2018.

(51) Int. Cl.
*F25B 19/00* (2006.01)
*F25B 49/00* (2006.01)
*F25B 41/31* (2021.01)

(52) U.S. Cl.
CPC ..... *F25B 19/00* (2013.01); *F25B 41/31* (2021.01); *F25B 49/00* (2013.01); *F25B 2400/0409* (2013.01); *F25B 2700/197* (2013.01)

(58) Field of Classification Search
CPC ..... F25B 41/20; F25B 41/33; F25B 41/40; F25B 41/003; F25B 41/043; F25B 2600/25; F25B 2700/00; F25B 2400/05; F25B 2400/053; F25B 19/00
See application file for complete search history.

(56) References Cited

U.S. PATENT DOCUMENTS

| | | | | |
|---|---|---|---|---|
| 1,836,318 | A | 12/1931 | Gay | |
| 2,083,611 | A | 6/1937 | Marshall | |
| 2,180,090 | A | 11/1939 | Mesinger | |
| 2,207,729 | A | 7/1940 | Goodman | |
| 2,226,797 | A | 12/1940 | Andersson | |
| 2,489,514 | A | 11/1949 | Benz | |
| 2,526,221 | A | 10/1950 | Goddard | |
| 2,785,540 | A * | 3/1957 | Biehn | F25B 13/00 62/159 |
| 2,885,864 | A | 5/1959 | Benjamin | |
| 3,073,380 | A | 1/1963 | Palmason | |

(Continued)

FOREIGN PATENT DOCUMENTS

| | | |
|---|---|---|
| JP | H11325662 | 11/1999 |
| WO | WO 2013/115156 | 8/2013 |

OTHER PUBLICATIONS

Alexandra Maratou, http://www.ammonia21.com/articles/3717/r717_vs_r404a_do_the_advantages_outweigh_the_disadvantages (2012) (Year: 2020).*

(Continued)

*Primary Examiner* — Elizabeth J Martin
(74) *Attorney, Agent, or Firm* — Fish & Richardson P.C.

(57) ABSTRACT

Thermal management systems include an open circuit refrigeration system featuring a receiver configurable to store a refrigerant fluid, an evaporator configurable to extract heat from a heat load when the heat load contacts the evaporator, and an exhaust line, where the receiver, the evaporator, and the exhaust line are connected to form a refrigerant fluid flow path, and a first control device configurable to control a vapor quality of the refrigerant fluid at an outlet of the evaporator along the refrigerant fluid flow path.

15 Claims, 12 Drawing Sheets

(56) References Cited

U.S. PATENT DOCUMENTS 3,131,548 A * 5/1964 Chubb ..... F25B 43/043 62/215
3,300,996 A * 1/1967 Atwood ..... F25B 41/04 62/117
3,468,421 A 9/1969 Hazel et al.
3,542,338 A 11/1970 Scaramucci
3,600,904 A 8/1971 Tilney
3,685,310 A * 8/1972 Fischer ..... F25B 41/04 62/117
3,789,583 A 2/1974 Smith
3,866,427 A 2/1975 Rothmayer et al.
3,882,689 A 5/1975 Rogers
4,015,439 A * 4/1977 Stern ..... F25B 23/00 62/115
4,016,657 A 4/1977 Passey
4,045,972 A * 9/1977 Tyree, Jr. ..... F25B 19/00 62/51.1
4,054,433 A 10/1977 Buffiere et al.
4,123,919 A 11/1978 Fehlhaber
4,151,724 A 5/1979 Garland
4,169,361 A 10/1979 Baldus
4,275,570 A 6/1981 Szymaszek et al.
4,313,305 A 2/1982 Egosi
4,323,109 A 4/1982 Jaster
4,352,272 A 10/1982 Taplay
4,419,865 A 12/1983 Szymaszek
4,438,635 A 3/1984 McCoy, Jr.
4,466,253 A 8/1984 Jaster
4,539,816 A 9/1985 Fox
4,870,830 A 10/1989 Hohenwarter et al.
4,969,495 A 11/1990 Grant
5,088,304 A 2/1992 Schlichtig
5,094,277 A 3/1992 Grant
5,127,230 A 7/1992 Nesser et al.
5,174,126 A 12/1992 Cameron
5,176,008 A 1/1993 Van Steenburgh, Jr.
5,187,953 A 2/1993 Mount
5,191,776 A 3/1993 Severance et al.
5,245,840 A 9/1993 Van Steenburgh, Jr.
5,297,392 A * 3/1994 Takata ..... F25D 21/08
5,325,894 A 7/1994 Kooy et al.
5,353,603 A 10/1994 Outlaw et al.
5,360,139 A 11/1994 Goode
5,429,179 A 7/1995 Klausing
5,471,848 A 12/1995 Major et al.
5,513,961 A 5/1996 Engdahl et al.
5,626,026 A * 5/1997 Sumida ..... F25B 9/006 62/502
5,690,743 A 11/1997 Murakami et al.
5,762,119 A 6/1998 Platz et al.
5,974,812 A 11/1999 Kátai et al.
6,044,647 A 4/2000 Drube et al.
6,076,360 A 6/2000 Viegas et al.
6,112,532 A 9/2000 Bakken
6,230,518 B1 5/2001 Hahn et al.
6,314,749 B1 11/2001 Van Steenburgh, Jr.
6,336,333 B1 1/2002 Lindgren
6,354,088 B1 3/2002 Emmer et al.
6,381,972 B1 5/2002 Cotter
6,427,453 B1 8/2002 Holtzapple et al.
6,474,101 B1 11/2002 Quine et al.
6,564,578 B1 * 5/2003 Fischer-Calderon ..... F25J 1/0022 62/613
6,684,658 B2 2/2004 Holtzapple et al.
6,964,168 B1 11/2005 Pierson et al.
7,287,581 B2 10/2007 Ziehr et al.
7,377,126 B2 * 5/2008 Gorbounov ..... F25B 41/00 62/513
7,497,180 B2 3/2009 Karlsson et al.
7,891,197 B2 2/2011 Winter
7,987,685 B2 8/2011 Oshitani et al.
9,016,413 B2 4/2015 Ikeya
9,267,645 B2 2/2016 Mackey
9,331,349 B2 5/2016 Yamazaki et al.
9,791,221 B1 * 10/2017 Litch ..... F25B 41/04
9,887,079 B2 2/2018 Sugawara et al.
9,987,904 B2 6/2018 Koyama et al.
10,126,022 B1 11/2018 Cooper
10,612,821 B1 4/2020 Fernando
10,907,869 B2 2/2021 Hagh et al.
11,112,155 B1 9/2021 Vaisman et al.
11,168,925 B1 11/2021 Vaisman et al.
11,231,209 B2 1/2022 Cavalleri et al.
11,293,673 B1 4/2022 Vaisman et al.
2002/0088243 A1 7/2002 Holtzapple et al.
2002/0121100 A1 * 9/2002 Yabuki ..... F25B 49/005 62/149
2002/0148225 A1 10/2002 Lewis
2002/0157407 A1 * 10/2002 Weng ..... F25B 41/20 62/196.4
2004/0123624 A1 7/2004 Ohta et al.
2004/0151230 A1 * 8/2004 Das ..... G01K 1/143 374/E1.019
2004/0154328 A1 8/2004 Holtzapple et al.
2005/0060970 A1 3/2005 Polderman
2005/0201429 A1 9/2005 Rice et al.
2006/0207285 A1 9/2006 Oshitani et al.
2006/0218964 A1 10/2006 Saito et al.
2006/0222522 A1 10/2006 Holtzapple
2006/0254308 A1 11/2006 Yokoyama et al.
2007/0000262 A1 1/2007 Ikegami et al.
2007/0007879 A1 1/2007 Bergman, Jr. et al.
2007/0039349 A1 2/2007 Yamada et al.
2007/0180852 A1 8/2007 Sugiura et al.
2008/0087040 A1 4/2008 Oshitani et al.
2008/0092559 A1 4/2008 Williams et al.
2008/0148754 A1 6/2008 Snytsar
2008/0196446 A1 8/2008 Nakamura et al.
2009/0110986 A1 4/2009 Choi et al.
2009/0158727 A1 * 6/2009 Bitter ..... F04B 23/04 60/428
2009/0211298 A1 8/2009 Saul
2009/0219960 A1 9/2009 Uberna et al.
2009/0228152 A1 9/2009 Anderson et al.
2010/0043467 A1 * 2/2010 Kawano ..... F25B 13/00 62/129
2010/0098525 A1 4/2010 Guelich
2010/0154395 A1 6/2010 Frick
2011/0005268 A1 * 1/2011 Oshitani ..... F25B 41/00 62/500
2011/0114284 A1 5/2011 Siegenthaler
2011/0185712 A1 * 8/2011 Burns ..... F22B 1/18 165/182
2011/0185726 A1 8/2011 Burns et al.
2011/0209771 A1 9/2011 Yung et al.
2011/0314805 A1 12/2011 Seale et al.
2012/0167601 A1 7/2012 Cogswell et al.
2012/0204583 A1 * 8/2012 Liu ..... F25B 41/067 62/129
2012/0312379 A1 12/2012 Gielda et al.
2013/0000341 A1 1/2013 De Piero et al.
2013/0025305 A1 1/2013 Higashiiue et al.
2013/0055751 A1 * 3/2013 Inaba ..... F25B 5/04 62/498
2013/0104593 A1 5/2013 Occhipinti
2013/0111934 A1 5/2013 Wang et al.
2013/0125569 A1 5/2013 Verma et al.
2013/0340622 A1 12/2013 Marty et al.
2014/0075984 A1 3/2014 Sugawara et al.
2014/0165633 A1 6/2014 De Piero et al.
2014/0166238 A1 6/2014 Sandu
2014/0260341 A1 9/2014 Vaisman et al.
2014/0331699 A1 11/2014 Higashiiue
2014/0342260 A1 11/2014 Koyama et al.
2014/0345318 A1 11/2014 Nagano et al.
2014/0356748 A1 12/2014 Yamazaki et al.
2014/0366563 A1 12/2014 Vaisman et al.
2015/0059379 A1 3/2015 Ootani et al.
2015/0260435 A1 9/2015 Kawano et al.
2015/0260463 A1 9/2015 Laughlin et al.
2015/0263477 A1 9/2015 Onaka

(56) References Cited

U.S. PATENT DOCUMENTS

| | | | | |
|---|---|---|---|---|
| 2016/0010907 | A1 | 1/2016 | Ali | |
| 2016/0054040 | A1 | 2/2016 | Jonsson et al. | |
| 2016/0114260 | A1 | 4/2016 | Frick | |
| 2016/0200175 | A1 | 7/2016 | Nakajima et al. | |
| 2016/0201956 | A1* | 7/2016 | Tamura | F25B 39/00 62/157 |
| 2016/0216029 | A1 | 7/2016 | Ragot | |
| 2016/0291137 | A1 | 10/2016 | Sakimura et al. | |
| 2016/0333747 | A1 | 11/2016 | KanFman | |
| 2017/0002731 | A1 | 1/2017 | Wei | |
| 2017/0081982 | A1 | 3/2017 | Kollmeier et al. | |
| 2017/0108263 | A1 | 4/2017 | Cermak et al. | |
| 2017/0167767 | A1 | 6/2017 | Shi et al. | |
| 2017/0205120 | A1* | 7/2017 | Ali | F25B 9/008 |
| 2017/0299229 | A1 | 10/2017 | Carter et al. | |
| 2018/0023805 | A1 | 1/2018 | Qin et al. | |
| 2018/0111504 | A1 | 4/2018 | Matsusue et al. | |
| 2018/0180307 | A1 | 6/2018 | Owejan et al. | |
| 2018/0245740 | A1 | 8/2018 | Kaminsky et al. | |
| 2018/0245835 | A1 | 8/2018 | Kamei et al. | |
| 2018/0328638 | A1 | 11/2018 | Mahmoud et al. | |
| 2019/0049154 | A1* | 2/2019 | Ikeda | F25B 43/02 |
| 2019/0111764 | A1 | 4/2019 | Oshitani et al. | |
| 2019/0170425 | A1* | 6/2019 | Takami | F25D 21/08 |
| 2019/0203988 | A1* | 7/2019 | Kobayashi | F25B 49/02 |
| 2019/0248450 | A1 | 8/2019 | Lee et al. | |
| 2019/0293302 | A1 | 9/2019 | Van et al. | |
| 2019/0338993 | A1* | 11/2019 | Aikawa | F25B 41/24 |
| 2019/0393525 | A1 | 12/2019 | Diethelm et al. | |
| 2020/0158386 | A1* | 5/2020 | Wu | F25B 49/02 |
| 2020/0239109 | A1 | 7/2020 | Lee et al. | |
| 2020/0363101 | A1 | 11/2020 | Jansen | |
| 2022/0026127 | A1* | 1/2022 | Vestergaard | F25B 49/02 |

OTHER PUBLICATIONS

Thermal expansion valve—Wikipedia (https://en.wikipedia.org/wiki/Thermal_expansion_valve) (Feb. 14, 2015) (Year: 2020).*
Thermal expansion valve—Wikipedia (https://en.wikipedia.org/wiki/Thermal_expansion_valve) (Jan. 8, 2020) (Year: 2020).*
Thermostatic Expansion Valves, Parker Hannifin Corporation, Sporlan Division (2011) (Year: 2011).*
HBDX-SENSOR_&_REGULATOR, instruction-manual, HB Products (Year: 2022).*
U.S. Appl. No. 16/448,196, filed Jun. 21, 2019, Vaisman et al.
U.S. Appl. No. 16/448,283, filed Jun. 21, 2019, Vaisman et al.
U.S. Appl. No. 16/448,332, filed Jun. 21, 2019, Vaisman et al.
U.S. Appl. No. 16/448,388, filed Jun. 21, 2019, Vaisman et al.
U.S. Appl. No. 16/666,851, filed Oct. 29, 2019, Davis et al.
U.S. Appl. No. 16/666,859, filed Oct. 29, 2019, Davis et al.
U.S. Appl. No. 16/666,865, filed Oct. 29, 2019, Davis et al.
U.S. Appl. No. 16/666,881, filed Oct. 29, 2019, Davis et al.
U.S. Appl. No. 16/666,899, filed Oct. 29, 2019, Davis et al.
U.S. Appl. No. 16/666,940, filed Oct. 29, 2019, Vaisman et al.
U.S. Appl. No. 16/666,950, filed Oct. 29, 2019, Vaisman et al.
U.S. Appl. No. 16/666,954, filed Oct. 29, 2019, Vaisman et al.
U.S. Appl. No. 16/666,959, filed Oct. 29, 2019, Vaisman et al.
U.S. Appl. No. 16/666,962, filed Oct. 29, 2019, Vaisman et al.
U.S. Appl. No. 16/666,966, filed Oct. 29, 2019, Vaisman et al.
U.S. Appl. No. 16/666,973, filed Oct. 29, 2019, Vaisman et al.
U.S. Appl. No. 16/666,977, filed Oct. 29, 2019, Vaisman et al.
U.S. Appl. No. 16/666,986, filed Oct. 29, 2019, Vaisman et al.
U.S. Appl. No. 16/666,992, filed Oct. 29, 2019, Vaisman et al.
U.S. Appl. No. 16/666,995, filed Oct. 29, 2019, Vaisman et al.
U.S. Appl. No. 16/684,775, filed Nov. 15, 2019, Peters et al.
U.S. Appl. No. 16/807,340, filed Mar. 3, 2020, Vaisman.
U.S. Appl. No. 16/807,353, filed Mar. 3, 2020, Vaisman.
U.S. Appl. No. 16/807,411, filed Mar. 3, 2020, Vaisman.
U.S. Appl. No. 16/807,413, filed Mar. 3, 2020, Vaisman.
U.S. Appl. No. 16/807,582, filed Mar. 3, 2020, Vaisman.
U.S. Appl. No. 16/872,584, filed May 12, 2020, Vaisman et al.
U.S. Appl. No. 16/872,590, filed May 12, 2020, Vaisman et al.
U.S. Appl. No. 16/872,592, filed May 12, 2020, Vaisman et al.
NASA History Office, "Quest for Performance: The Evolution of Modern Aircraft, Part II: The Jet Age, Chapter 10: Technology of the Jet Airplane, Turbojet and Turbofan Systems," NASA Scientific and Technical Information Branch, originally published in 1985, last updated Aug. 6, 2004, 21 pages.
Elstroem, "Capacitive Sensors Measuring the Vapor Quality, Phase of the refrigerant and Ice thickness for Optimized evaporator performance," Proceedings of the 13th IIR Gustav Lorentzen Conference on Natural Refrigerants (GL:2018), Valencia, Spain, Jun. 18-20, 2018, 10 pages.
Elstroem, "New Refrigerant Quality Measurement and Demand Defrost Methods," 2017 IIAR Natural Refrigeration Conference & Heavy Equipment Expo, San Antonio, TX, Technical Paper #1, 38 pages.
en.wikipedia.org [online] "Inert gas—Wikipedia" retrieved on Oct. 1, 2021, retrieved from URL < https://en.wikipedia.org/w/index.php?title=lnert_gas&oldid=1047231716>, 4 pages.
en.wikipedia.org [online] "Pressure regulator—Wikipedia," retrieved on Oct. 7, 2021, retrieved from URL < https://en.wikipedia.org/wiki/Pressure_regulator>, 8 pages.
en.wikipedia.org [online], "lsenthalpic process—Wikipedia, the free encyclopedia," available on or before Mar. 29, 2015, via Internet Archive: Wayback Machine URL <https://web.archive.org/web/20150329105343/https://en.wikipedia.org/wiki/lsenthalpicprocess>, retrieved on Jan. 12, 2021, retrieved from URL <https://en.wikipedia.org/wiki/lsenthalpicprocess>, 2 pages.
engineersedge.com [online], "Throttling Process Thermodynamic," Apr. 16, 2015, via Internet Archive: Wayback Machine URL <https://web.archive.org/web/20150416181050/https://www.engineersedge.conn/thernnodynannics/throttling process.htm>, retrieved on Jan. 12, 2021, retrieved from URL <https://en.wikipedia.org/wiki/lsenthalpicprocess>, 1 pages.
International Search Report and Written Opinion in International Appln. No. PCT/US2020/056787, dated Jan. 27, 2021, 13 pages.
Ohio.edu [online], "20 Engineering Thermodynamics Israel Urieli", Sep. 9, 2009, retrieved from URL< https://www.ohio.edu/mechanical/thermo/lntro/Chapt.1_6/Chapter2a.html>, 1 page.
osha.gov, [online] "Storage and handling of anhydrous ammonia," Part No. 1910, Standard No. 1910.111, GPO Source: e-CFR, 2005, retrieved on Oct. 2, 2021, retrieved from URL < https://www.osha.gov/laws-regs/regulations/standardnumber/1910/1910.111>, 31 pages.
thermal-engineering.org [online] "What is Vapor Quality—Dryness Fraction—Definition," May 22, 2019, retrieved on Oct. 19, 2021, retrieved from URL < https://www.thermal-engineering.org/what-is-vapor-quality-dryness-fraction-definition/>, 6 pages.
Wojtan et al., "Investigation of flow boiling in horizontal tubes: Part I—A new diabatic two-phase flow pattern map. International journal of heat and mass transfer," Jul. 2005, 48(14):2955-69.
Wojtan et al., "Investigation of flow boiling in horizontal tubes: Part II—Development of a new heat transfer model for stratified-wavy, dryout and mist flow regimes," International journal of heat and mass transfer, Jul. 2005, 48(14):2970-85.
forumautomation.com [online], "What is an expansion valve and what are its types," Jun. 14, 2020, retrieved on Jan. 10, 2022, retrieved from URLhttps://forumautomation.com/t/what-is-an-expansion-valve-and-what-are-its-types/8385, 5 pages.
Merriam-Webster.com [online], "Adjacent," retrieved on Jan. 25, 2023, retrieved from URL <https://www.merriam-webster.com/dictionary/adjacent>, 7 pages.
Merriam-Webster.com [online], "Value," retrieved on Jan. 25, 2023, retrieved from URL <https://www.merriam-webster.com/dictionary/value>, 17 pages.

* cited by examiner

THERMAL MANAGEMENT SYSTEMS

CLAIM OF PRIORITY

This application claims priority under 35 USC § 119(e) to U.S. Provisional Patent Application No. 62/689,034, filed on Jun. 22, 2018, the entire contents of which are incorporated by reference herein.

BACKGROUND

Refrigeration systems absorb thermal energy from the heat sources operating at temperatures below the temperature of the surrounding environment, and discharge thermal energy into the surrounding environment. Conventional refrigeration systems can include at least a compressor, a heat rejection exchanger (i.e., a condenser), a liquid refrigerant receiver, an expansion device, and a heat absorption exchanger (i.e., an evaporator). Such systems can be used to maintain operating temperature set points for a wide variety of cooled heat sources (loads, processes, equipment, systems) thermally interacting with the evaporator. While, closed-circuit refrigeration systems may pump significant amounts of absorbed thermal energy from heat sources into the surrounding environment, such systems may not be adequate for specific applications. Consider that condensers and compressors are generally heavy and consume relatively large amounts of power for a given amount of heat removal capacity. In general, the larger the amount of absorbed thermal energy that the system is designed to handle, the heavier the refrigeration system and the larger the amount of power consumed during operation, even when cooling of a heat source occurs over relatively short time periods.

SUMMARY

This disclosure features thermal management systems that include open circuit refrigeration systems (OCRSs). Open circuit refrigeration systems generally include a liquid refrigerant receiver, an expansion device, and a heat absorption exchanger (i.e., an evaporator). The receiver stores liquid refrigerant which is used to cool heat loads. Typically, the longer the desired period of operation of an open circuit refrigeration system, the larger the receiver and the charge of refrigerant fluid contained within it. OCRSs are useful in many circumstances, including in systems where dimensional and/or weight constraints are such that heavy compressors and condensers typical of closed circuit refrigeration systems are impractical, and/or power constraints make driving the components of closed circuit refrigeration systems infeasible.

The open circuit refrigeration systems disclosed herein use a mixture of two different phases (e.g., liquid and vapor) of a refrigerant fluid to extract heat energy from a heat load. In particular, for high heat flux loads that are to be maintained within a relatively narrow range of temperatures, heat energy absorbed from the high heat flux load can be used to drive a liquid-to-vapor phase transition in the refrigerant fluid, which occurs at a constant temperature. As a result, the temperature of the high heat flux load can be stabilized to within a relatively narrow range of temperatures. Such temperature stabilization can be particularly important for heat-sensitive high flux loads such as electronic components and devices, which can be easily damaged via excess heating. Refrigerant fluid emerging from the evaporator can be used for cooling of secondary heat loads that do not require temperature regulation to within such a narrow temperature range.

Exhaust refrigerant can be used in the systems disclosed herein in various ways. It can be discharged into ambient environment if there is no prohibitive regulation. Alternatively, depending upon the nature of the refrigerant fluid, exhaust vapor can be incinerated in a combustion unit and used to perform mechanical work. As another example, the vapor can be scrubbed or otherwise chemically treated.

The open circuit refrigeration systems disclosed herein have a number of important advantages. For example, relative to closed-circuit systems, the absence of compressors and condensers can result in a significant reduction in the overall size, mass, and power consumption of such systems, relative to conventional closed-circuit systems, particularly when the open circuit refrigeration systems are sized for operation over relatively short time period.

The benefit of maintaining the refrigerant fluid within a two-phase (liquid and vapor) region of the refrigerant fluid's phase diagram, is that the heat extracted from high heat flux loads can be used to drive a constant-temperature liquid to vapor phase transition of the refrigerant fluid, allowing the refrigerant fluid to absorb heat from a high heat flux load without undergoing a significant temperature change. Consequently, the temperature of a high heat flux load can be stabilized within a range of temperatures that is relatively small, even though the amount of heat generated by the load and absorbed by the refrigerant fluid is relatively large.

According to an aspect, a thermal management system includes an open circuit refrigeration system featuring a receiver configurable to store a refrigerant fluid, an evaporator configurable to extract heat from a heat load when the heat load contacts the evaporator, an exhaust line, and a control device configurable to control a vapor quality of the refrigerant fluid at an outlet of the evaporator, with the receiver, the evaporator, and the exhaust line coupled to form a refrigerant fluid flow path.

Some of the features that can be included in the above aspect can be one or more or a combination of the following features.

The control device can be configurable to receive liquid refrigerant fluid from the receiver at a first pressure, expand the liquid refrigerant fluid to generate a refrigerant fluid mixture at a second pressure, with the refrigerant fluid mixture featuring liquid refrigerant fluid and refrigerant fluid vapor, and direct the refrigerant fluid mixture into the evaporator.

The control device can include a flow regulation apparatus. The flow regulation apparatus can include an expansion valve.

The control device can be configured to perform a constant-enthalpy expansion of the liquid refrigerant fluid to generate the refrigerant fluid mixture. The refrigerant fluid can include ammonia.

The control device can be a first control device, and the system can include a second control device configurable to control a temperature of the heat load. The second control device can include a flow regulation apparatus connected downstream from the evaporator along the refrigerant fluid flow path. The regulation apparatus can include a back pressure regulator. The back pressure regulator can be configurable to receive refrigerant fluid vapor generated in the evaporator and to regulate a pressure of the refrigerant fluid upstream from the back pressure regulator along the refrigerant fluid flow path. The back pressure regulator can be configurable to perform an expansion of the refrigerant fluid vapor.

The refrigerant fluid from the exhaust line can be discharged so that the discharged refrigerant fluid is not returned to the receiver.

The system can include an exhaust processing apparatus (e.g., a refrigerant processing apparatus) coupled to the exhaust line and configurable to receive refrigerant fluid from the evaporator. The exhaust processing apparatus can include at least one of: a chemical scrubber configurable to convert the refrigerant fluid into one or more products that are chemically different from the refrigerant fluid; an adsorbent material configurable to adsorb particles of the refrigerant fluid; and an incinerator configurable to incinerate the refrigerant.

The system can include an exhaust processing apparatus coupled to the exhaust line and configurable to receive refrigerant fluid from the second control device. The processing apparatus can include at least one of: a chemical scrubber configurable to convert the refrigerant fluid into one or more products that are chemically different from the refrigerant fluid; an adsorbent material configurable to adsorb particles of the refrigerant fluid; and an incinerator configurable to incinerate the refrigerant.

Embodiments of the system can also include any of the other features disclosed herein, including any combinations of individual features discussed in connection with different embodiments, except where expressly stated otherwise.

According to an additional aspect, a thermal management method includes transporting a refrigerant fluid from a receiver through a control device, an evaporator configurable to extract heat from a heat load when the heat load contacts the evaporator, and an exhaust line, controlling a vapor quality of the refrigerant fluid at an outlet of the evaporator by operation of the control device, and discharging the refrigerant fluid from the exhaust line so that the discharged refrigerant fluid is not returned to the receiver.

Some of the features that can be included in the above aspect can be one or more or a combination of the following features.

The control device can be a first control device, and the method can include transporting the refrigerant fluid from the evaporator through a second control device prior to transporting the refrigerant fluid through the exhaust line, and controlling a temperature of the heat load by the second control device being responsive to the refrigerant fluid transporting from the evaporator through the second control device.

The method can include directing liquid refrigerant fluid from the receiver at a first pressure into the control device, expanding the liquid refrigerant fluid in the control device to generate a refrigerant fluid mixture at a second pressure, with the refrigerant fluid mixture comprising liquid refrigerant fluid and refrigerant fluid vapor, and directing the refrigerant fluid mixture out of the control device and into the evaporator.

The first control device can include an expansion valve and the second control device can include a back pressure regulator. The method can include regulating a pressure of the refrigerant fluid upstream from the back pressure regulator disposed upstream from the exhaust line.

The first and second control devices can be configurable to mechanically adjust their operation in direct response to physical properties, and the method can include adjusting the first control device based on a property of the refrigerant fluid flow through the first control device, and adjusting the second control device based on a property of the heat load.

Adjusting by the first control device can include mechanically coupling a deformation of a pressure-sensing bulb in response to a change in a pressure of the refrigerant fluid to a first actuation assembly of the first control device. Adjusting by the second control device can include directing a portion of the refrigerant fluid to flow into a second actuation assembly of the second control device.

Embodiments of the method can also include any of the other features disclosed herein, including any combinations of individual features discussed in connection with different embodiments, except where expressly stated otherwise.

According to an additional aspect, a thermal management system includes an open circuit refrigeration system featuring a receiver configurable to store a refrigerant fluid, an evaporator configurable to extract heat from a heat load when the heat load contacts the evaporator, a control device configurable to control a vapor quality of the refrigerant fluid at an outlet of the evaporator along the refrigerant fluid flow path, an exhaust line, with the receiver, the evaporator, the control device, and the exhaust line coupled to form a refrigerant fluid flow path, and with the refrigerant fluid from the exhaust line discharged so that the discharged refrigerant fluid is not returned to the receiver, and a heat exchanger coupled to the refrigerant fluid flow path, the heat exchanger including a first fluid path positioned so that refrigerant fluid from the receiver flows through the first fluid path to the first control device, and a second fluid path positioned so that refrigerant fluid from the evaporator flows through the second fluid path to transfer heat from the refrigerant fluid in the second fluid path to the refrigerant fluid in the first fluid path.

Some of the features that can be included in the above aspect can be one or more or a combination of the following features.

The control device can be a first control device, and the system can include a second control device positioned downstream from the evaporator along the refrigerant fluid flow path. The second control device can be configurable to control a temperature of the heat load.

The control device can be configurable to receive liquid refrigerant fluid from the receiver at a first pressure, expand the liquid refrigerant fluid to generate a refrigerant fluid mixture at a second pressure, with the refrigerant fluid mixture including liquid refrigerant fluid and refrigerant fluid vapor, and direct the refrigerant fluid mixture into the evaporator.

The control device can include a flow regulation apparatus. The flow regulation apparatus can include an expansion valve. The second control device can include a flow regulation apparatus. The flow regulation apparatus can include a back pressure regulator. The back pressure regulator can be configurable to receive refrigerant fluid vapor generated in the evaporator and to regulate a pressure of the refrigerant fluid upstream from the back pressure regulator along the refrigerant fluid flow path. The back pressure regulator can be configurable to perform an expansion of the refrigerant fluid vapor.

The system can include a first apparatus responsive to a property of the refrigerant fluid, which is configurable to adjust the first control device based on a first attribute of the system, and a second apparatus responsive to a property of the refrigerant fluid, which is configurable to adjust the second control device based on a second, different attribute of the system. The first control device can include an actuation assembly and the first apparatus can include a member coupled between the first control device and a first location along the refrigerant fluid flow path, with the member configurable to mechanically adjust the actuation assembly. The second control device can include an actuation assembly and the second apparatus can include a fluid conduit coupled between the second control device and a location along the refrigerant fluid flow path, which is configurable to transport refrigerant fluid from the location to the second control device to adjust the second actuation assembly by the transported refrigerant fluid.

The first control device can include a first actuation assembly that is adjustable based on one or more electrical signals, the first apparatus can be a measurement apparatus that transmits an electrical signal based on a refrigerant fluid pressure in the system, and the first control device can include an actuation assembly that is adjustable based on the electrical signal transmitted by the measurement apparatus. The first control device can include a first actuation assembly that is adjustable based on the one or more electrical signals, the first apparatus can be a measurement apparatus that transmits a signal based on a refrigerant fluid pressure in the system, and the measurement apparatus can include one or more refrigerant fluid pressure sensors positioned at one or more locations in the system, which measurement apparatus is configured to generate an electrical signal corresponding to a pressure of refrigerant fluid in contact with the one or more refrigerant fluid sensors.

The measurement apparatus can be configurable to transmit a signal corresponding to superheat information for refrigerant fluid downstream from a second evaporator heat load. The measurement apparatus can be configurable to transmit a signal corresponding to vapor quality information for refrigerant fluid emerging from an outlet of the evaporator.

The refrigerant fluid can include ammonia.

Embodiments of the system can also include any of the other features disclosed herein, including any combinations of individual features discussed in connection with different embodiments, except where expressly stated otherwise.

According to an additional aspect, a thermal management method includes transporting a refrigerant fluid from a receiver in a first direction through a heat exchanger, a control device, and an evaporator that is configurable to extract heat from a heat load when the heat load contacts the evaporator, and through the heat exchanger in a second direction toward an exhaust line, while transferring heat from the refrigerant fluid transported along the second direction to the refrigerant fluid transported along the first direction, controlling a vapor quality of the refrigerant fluid at an outlet of the evaporator by operation of the control device, and discharging the refrigerant fluid from the exhaust line so that the discharged refrigerant fluid is not returned to the receiver.

Some of the features that can be included in the above aspect can be one or more or a combination of the following features.

The method can include directing liquid refrigerant fluid from the receiver at a first pressure into the control device, expanding the liquid refrigerant fluid in the control device to generate a refrigerant fluid mixture at a second pressure, where the refrigerant fluid mixture includes liquid refrigerant fluid and refrigerant fluid vapor, and directing the refrigerant fluid mixture out of the control device and into the evaporator.

The method can include separating the refrigerant fluid mixture generated in the control device into refrigerant fluid vapor and liquid refrigerant fluid, directing at least a portion of the refrigerant fluid vapor along a flow path that bypasses the evaporator, and directing the liquid refrigerant fluid into the evaporator. The method can include directing the at least a portion of the refrigerant fluid vapor into the heat exchanger and along the second direction through the heat exchanger.

The control device can be a first control device, and the method can include, after transporting the refrigerant fluid through the evaporator and prior to transporting the refrigerant fluid toward the exhaust line, transporting the refrigerant fluid through a second control device, and controlling a temperature of the heat load by operation of the second control device.

The method can include adjusting the first control device based on a first attribute corresponding to a property of the refrigerant fluid, and adjusting the second control device based on a second attribute corresponding to a property of the heat load. The method can include adjusting the first control device by mechanically coupling a deformation of a pressure-sensing bulb in response to a change in a pressure of the refrigerant fluid to a first actuation assembly of the first control device. The method can include adjusting the second control device by directing a portion of the refrigerant fluid to flow into a second actuation assembly of the second control device.

Embodiments of the method can also include any of the other features disclosed herein, including any combinations of individual features discussed in connection with different embodiments, except where expressly stated otherwise.

According to an additional aspect, a thermal management system includes an open circuit refrigeration system featuring a receiver configurable to store a refrigerant fluid, an evaporator configurable to extract heat from a heat load when the heat load contacts the evaporator, a control device configurable to control a vapor quality of the refrigerant fluid at an outlet of the evaporator along the refrigerant fluid flow path, and an exhaust line, with the receiver, the evaporator, the control device, and the exhaust line coupled to form a refrigerant fluid flow path, and an incinerator coupled to the exhaust line and configurable to receive refrigerant fluid and to incinerate the refrigerant fluid.

Some of the features that can be included in the above aspect can be one or more or a combination of the following features.

The control device can be a first control device, and the system can include a second control device configurable to control a temperature of the heat load. The incinerator can be configurable to receive the refrigerant fluid from the second control device. The refrigerant fluid can include ammonia.

The incinerator can include a power conversion apparatus configurable to generate electrical energy during incineration of the refrigerant fluid. The power conversion apparatus can include an engine.

The incinerator can be configurable so that when the heat load is connected electrically to the incinerator, the incinerator delivers the electrical energy to the heat load to provide operating power to the heat load. The heat load can include one or more electronic devices.

The system can include a first apparatus configurable to adjust the first control device based on a property of the refrigerant fluid, and a second apparatus configurable to adjust the second control device based on a property of the heat load. The first control device can include a first actuation assembly and the first apparatus can include a member connected between the first control device and a first location along the refrigerant fluid flow path, the member configurable to mechanically adjust the first control device.

The second control device can include a second actuation assembly and the second apparatus can include a fluid conduit connected between the second control device and a second location along the refrigerant fluid flow path, which conduit transports refrigerant fluid from the second location to the second control device to adjust operation of the second control device directly in response to the transported refrigerant fluid.

The first apparatus can be configurable to transmit a signal based on a refrigerant fluid property in the system, and can include one or more refrigerant fluid property sensors, each of which is configurable to generate an electrical signal corresponding to a property of refrigerant fluid in contact with the sensor, with the first control device featuring a first actuation assembly that is adjustable based on the one or more electrical signals generated by the one or more refrigerant fluid property sensors, and with the one or more refrigerant fluid property sensors positioned to measure a refrigerant fluid property at one or more locations in the system.

Embodiments of the system can also include any of the other features disclosed herein, including any combinations of individual features discussed in connection with different embodiments, except where expressly stated otherwise.

According to an additional aspect, a thermal management method include transporting a refrigerant fluid from a receiver through a control device, an evaporator configurable to extract heat from a heat load when the heat load contacts the evaporator, and into an incinerator, controlling a vapor quality of the refrigerant fluid at an outlet of the evaporator by operation of the control device, and combusting the refrigerant fluid in the incinerator.

Some of the features that can be included in the above aspect can be one or more or a combination of the following features.

The method can include generating electrical energy during combustion of the refrigerant fluid. The method can include delivering the electrical energy to the heat load to provide operating power to the heat load. The heat load can include one or more electronic devices.

The control device can be a first control device, and the method can include, after transporting the refrigerant fluid through the evaporator and prior to transporting the refrigerant fluid into the incinerator, transporting the refrigerant fluid through a second control device, and controlling a temperature of the heat load by operation of the second control device.

The method can include combusting a refrigerant fluid featuring ammonia in the incinerator.

The second control device can include a flow regulation apparatus, and the method can include comprising regulating a pressure of the refrigerant fluid upstream from the second control device.

The method can include adjusting the first control device based on a property of the refrigerant fluid, and adjusting the second control device based on a property of the heat load.

The method can include adjusting the first control device by mechanically coupling a deformation of a pressure-sensing bulb in response to a change in a pressure of the refrigerant fluid to a first actuation assembly of the first control device. The method can include adjusting the second control device by directing a portion of the refrigerant fluid to flow into a second actuation assembly of the second control device.

The property of the refrigerant fluid can correspond to a refrigerant fluid pressure, and the method can include measuring information corresponding to one or more of a refrigerant fluid pressure adjacent to an outlet of the evaporator, a refrigerant fluid pressure adjacent to an outlet of the first control device, a refrigerant fluid pressure difference across the first control device, and a refrigerant fluid pressure difference across the evaporator, and transmitting the measured information to the first control device.

The property of the refrigerant fluid can correspond to superheat information for the refrigerant fluid, and the method can include measuring the superheat information at a location downstream from a second heat load, and transmitting the measured superheat information to the first control device. The property of the refrigerant fluid can correspond to vapor quality information for refrigerant fluid emerging from an outlet of the evaporator.

The property of the refrigerant fluid can correspond to temperature information, and the method can include measuring temperature information for one or more of refrigerant fluid emerging from the evaporator and refrigerant fluid within the evaporator, and transmitting the measured temperature information to the first control device.

Embodiments of the method can also include any of the other features disclosed herein, including any combinations of individual features discussed in connection with different embodiments, except where expressly stated otherwise.

According to an additional aspect, a thermal management system includes an open circuit refrigeration system featuring a receiver configurable to store a refrigerant fluid, an evaporator configurable to extract heat from a heat load when the heat load contacts the evaporator, a control device configurable to control a vapor quality of the refrigerant fluid at an outlet of the evaporator along the refrigerant fluid flow path, and an exhaust line, with the receiver, the evaporator, the control device, and the exhaust line coupled to form a refrigerant fluid flow path, and a measurement apparatus configurable to adjust the control device based on an attribute of the system, the measurement apparatus featuring a set of one or more property sensors to generate an electrical signal corresponding to a measurable property of the system.

Some of the features that can be included in the above aspect can be one or more or a combination of the following features.

The control device can include an actuation assembly that is adjustable based on the electrical signal generated by the set of one or more property sensors. The attribute can be a refrigerant fluid pressure, and the measurement apparatus can include one or more refrigerant fluid pressure sensors. The one or more refrigerant fluid pressure sensors can be positioned at one or more locations in the system and the sensors can generate electrical signals that represent one or more of a refrigerant fluid pressure adjacent to an outlet of the evaporator, a refrigerant fluid pressure adjacent to an outlet of the control device, a refrigerant fluid pressure difference across the control device, and a refrigerant fluid pressure difference across the evaporator.

The attribute can be superheat information for the refrigerant fluid, and the measurement apparatus can include a sensor positioned to generate an electrical signal featuring superheat information for refrigerant fluid downstream from a second heat load. The attribute can be vapor quality information for the refrigerant fluid, and the measurement apparatus can include a sensor positioned to generate an electrical signal featuring vapor quality information for refrigerant fluid emerging from an outlet of the evaporator. The attribute can be a temperature, and the measurement apparatus can include one or more temperature sensors each configurable to generate an electrical signal corresponding to a temperature of an object or substance in contact with the sensor. The one or more temperature sensors of the measurement apparatus can be positioned to generate electrical signals that represent temperature information for one or more of refrigerant fluid emerging from the evaporator, refrigerant fluid within the evaporator, and the heat load.

The control device can be configurable to receive liquid refrigerant fluid from the receiver at a first pressure, expand the liquid refrigerant fluid to generate a refrigerant fluid mixture at a second pressure, with the refrigerant fluid mixture including liquid refrigerant fluid and refrigerant fluid vapor, and direct the refrigerant fluid mixture into the evaporator. The control device can include a flow regulation apparatus. The control device can be configurable to perform a constant-enthalpy expansion of the liquid refrigerant fluid to generate the refrigerant fluid mixture.

The control device can be a first control device, the measurement apparatus can be a first measurement apparatus, the set of property sensors can be a first set of property sensors, the attribute can be a first attribute, and the system can include a second control device configurable to control a temperature of the heat load, and a second measurement apparatus configurable to adjust the second control device based on a second, different attribute of the system, featuring a second set of one or more property sensors, each of which is configurable to generate an electrical signal corresponding to a measurable property of the system. The second control device can include a second actuation assembly that is adjustable based on the one or more electrical signals generated by the second set of one or more property sensors.

The second control device can include a flow regulation apparatus connected downstream from the evaporator along the refrigerant fluid flow path, and the flow regulation apparatus can be configurable to receive refrigerant fluid vapor generated in the evaporator and to regulate a pressure of the refrigerant fluid upstream from the flow regulation apparatus along the refrigerant fluid flow path.

The second attribute can be a refrigerant fluid pressure, and the second measurement apparatus can include one or more refrigerant fluid pressure sensors. The one or more refrigerant fluid pressure sensors can be positioned at one or more locations in the system to generate electrical signals that represent one or more of a refrigerant fluid pressure adjacent to an outlet of the evaporator, a refrigerant fluid pressure adjacent to an outlet of the first control device, a refrigerant fluid pressure difference across the first control device, and a refrigerant fluid pressure difference across the evaporator.

The second attribute can be superheat information for the refrigerant fluid, and the second measurement apparatus can include a sensor positioned to generate an electrical signal featuring superheat information for refrigerant fluid downstream from a second heat load. The second attribute can be vapor quality information for the refrigerant fluid, and the second measurement apparatus can include a sensor positioned to generate an electrical signal featuring vapor quality information for refrigerant fluid emerging from an outlet of the evaporator.

The second attribute can be a temperature, and the second measurement apparatus can include one or more temperature sensors each configurable to generate an electrical signal corresponding to a temperature of an object or substance in contact with the sensor. The one or more temperature sensors of the second measurement apparatus can be positioned to generate electrical signals that represent temperature information for one or more of refrigerant fluid emerging from the evaporator, refrigerant fluid within the evaporator, and the heat load.

The system can include a phase separator positioned downstream from the evaporator and configurable to receive refrigerant fluid emerging from the evaporator, direct refrigerant fluid vapor toward the exhaust line, and direct liquid refrigerant fluid into an auxiliary flow path that bypasses the exhaust line. The system can include a conduit that forms the auxiliary flow path that is connected to a location along the refrigerant fluid flow path upstream from the evaporator, with the liquid refrigerant fluid discharged through an outlet of the conduit.

The system can include a controller configurable to receive or more electrical signals generated by the set of one or more property sensors, process the signals to provide one or more control signals, and cause transmission of the one or more control signals to the control device to adjust the control device.

Embodiments of the system can also include any of the other features disclosed herein, including any combinations of individual features discussed in connection with different embodiments, except where expressly stated otherwise.

According to an additional aspect, a thermal management method includes transporting a refrigerant fluid from a receiver through a control device, an evaporator configurable to extract heat from a heat load when the heat load contacts the evaporator, and an exhaust line, controlling a vapor quality of the refrigerant fluid at an outlet of the evaporator by operation of the control device, by measuring a property of the refrigerant fluid and adjusting the control device based on the measured property, and discharging the refrigerant fluid from the exhaust line so that the discharged refrigerant fluid is not returned to the receiver.

Some of the features that can be included in the above aspect can be one or more or a combination of the following features.

The property can be selected from the group consisting of a pressure of the refrigerant fluid, superheat information for the refrigerant fluid, vapor quality information for the refrigerant fluid, a temperature of the refrigerant fluid, and a temperature of the heat load.

The control device can be a first control device and the property can be a first property, and the method can include, after transporting the refrigerant fluid through the evaporator and prior to transporting the refrigerant fluid to the exhaust line, transporting the refrigerant fluid through a second control device, and controlling a temperature of the heat load by operation of the second control device, by measuring a second property different from the first property, and adjusting the second control device based on the measured second property. The second property can be selected from the group consisting of a pressure of the refrigerant fluid, superheat information for the refrigerant fluid, vapor quality information for the refrigerant fluid, a temperature of the refrigerant fluid, and a temperature of the heat load.

Embodiments of the method can also include any of the other features disclosed herein, including any combinations of individual features discussed in connection with different embodiments, except where expressly stated otherwise.

According to an additional aspect, a thermal management system includes an open circuit refrigeration system featuring a receiver configurable to store a refrigerant fluid, an evaporator configurable to extract heat from a heat load when the heat load contacts the evaporator, a control device configurable to control a vapor quality of the refrigerant fluid at an outlet of the evaporator, and an exhaust line, with the receiver, the evaporator, the control device, and the exhaust line coupled to form a refrigerant fluid flow path, and a measurement apparatus configurable to adjust the control device based on an attribute of the system, the measurement apparatus featuring a controller including a processing unit configurable to execute compute instructions to receive data from plural sensor devices that generate electrical signals corresponding to measurable properties of the system, and control operation of the control device according to the received data from plural sensor devices.

Some of the features that can be included in the above aspect can be one or more or a combination of the following features.

The control device can include an actuation assembly that is adjustable based on one or more electrical signals generated by the controller.

The system can include one or more refrigerant fluid pressure sensors positioned to measure refrigerant fluid pressure at one or more locations in the system, and to generate electrical signals that represent one or more of: a refrigerant fluid pressure adjacent to an outlet of the evaporator; a refrigerant fluid pressure adjacent to an outlet of the first control device; a refrigerant fluid pressure difference across the first control device; and a refrigerant fluid pressure difference across the evaporator. The measurement apparatus can be configurable to transmit one or more electrical signals that are generated by the controller based on a refrigerant fluid pressure measured in the system by the one or more refrigerant fluid pressure sensors.

The control device can be a first control device, and the system can include a second control device configurable to control a temperature of the heat load. The measurement apparatus can be configurable to adjust operation of the second control device according to the received data from plural sensor devices.

The measurement apparatus can be configurable to transmit a signal corresponding to superheat information for refrigerant fluid downstream from a second heat load to control the first control device according to the superheat information. The measurement apparatus can be configurable to transmit a signal corresponding to superheat information for refrigerant fluid downstream from a second heat load to control the second control device according to the superheat information. The measurement apparatus can be configurable to transmit a signal corresponding to vapor quality information for refrigerant fluid emerging from an outlet of the evaporator to control the first control device according to the vapor quality information.

The measurement apparatus can be configurable to transmit a signal corresponding to vapor quality information for refrigerant fluid emerging from an outlet of the evaporator to control the second control device according to the vapor quality information.

Embodiments of the system can also include any of the other features disclosed herein, including any combinations of individual features discussed in connection with different embodiments, except where expressly stated otherwise.

According to an additional aspect, a thermal management system includes an open circuit refrigeration system featuring a receiver configurable to store a refrigerant fluid, an evaporator configurable to extract heat from a first heat load when the first heat load contacts the evaporator, an exhaust line that exhausts refrigerant vapor from the evaporator and which does not return the exhausted refrigerant vapor to the receiver, a control device configurable to control a vapor quality of the refrigerant fluid at an outlet of the evaporator, with the receiver, the evaporator, and the exhaust line coupled to form a refrigerant fluid flow path, and a heat exchanger coupled along the refrigerant fluid flow path and configurable so that when a second heat load is coupled to the heat exchanger, the heat exchanger extracts heat from the second heat load.

Some of the features that can be included in the above aspect can be one or more or a combination of the following features.

The heat exchanger can be configurable to receive refrigerant fluid vapor from the evaporator and to transfer heat extracted from the second heat load to the refrigerant fluid vapor.

The control device can be a flow regulation apparatus.

The control device can be a first control device, and the system can include a second control device configurable to control a temperature of the first heat load. The second control device can include a flow regulation apparatus coupled downstream from the evaporator along the refrigerant fluid flow path. The second control device can be configurable to receive refrigerant fluid vapor generated in the evaporator and to regulate a pressure of the refrigerant fluid upstream from the second control device along the refrigerant fluid flow path.

The heat exchanger can be positioned between the evaporator and the second control device along the refrigerant fluid flow path. The heat exchanger can be positioned downstream from the second control device along the refrigerant fluid flow path.

The control device can be configured to receive liquid refrigerant fluid from the receiver at a first pressure, expand the liquid refrigerant fluid to generate a refrigerant fluid mixture at a second pressure, where the refrigerant fluid mixture includes liquid refrigerant fluid and refrigerant fluid vapor, and direct the refrigerant fluid mixture into the evaporator. The control device can be configurable to maintain a vapor quality of the refrigerant fluid at the outlet of the evaporator at value of substantially 1.0 during operation of the system.

Embodiments of the system can also include any of the other features disclosed herein, including any combinations of individual features discussed in connection with different embodiments, except where expressly stated otherwise.

According to an additional aspect, a thermal management system includes an open circuit refrigeration system featuring a receiver configurable to store a refrigerant fluid, an evaporator configurable to extract heat from a heat load when the heat load contacts the evaporator, an exhaust line that exhausts refrigerant vapor from the evaporator and which does not return the exhausted refrigerant vapor to the receiver, a control device configurable to control a vapor quality of the refrigerant fluid at an outlet of the evaporator, with the receiver, the evaporator, and the exhaust line coupled to form a refrigerant fluid flow path, and a phase separator configurable to receive a refrigerant fluid mixture from the control device and direct refrigerant fluid vapor of the mixture along an auxiliary flow path that bypasses the evaporator.

Some of the features that can be included in the above aspect can be one or more or a combination of the following features.

The phase separator can be configurable to direct liquid refrigerant fluid of the mixture into the evaporator. The system can include a conduit that forms the auxiliary flow path, and is connected to the refrigerant fluid flow path downstream from the evaporator.

The control device can be configurable to receive refrigerant fluid from the receiver at a first pressure, and expand the liquid refrigerant fluid to generate the refrigerant fluid mixture at a second pressure, the refrigerant fluid mixture featuring the liquid refrigerant fluid and the refrigerant fluid vapor. The control device can be a first control device, and the system can include a second control device configurable to control a temperature of the heat load.

Embodiments of the system can also include any of the other features disclosed herein, including any combinations of individual features discussed in connection with different embodiments, except where expressly stated otherwise.

According to an additional aspect, a thermal management system includes an open circuit refrigeration system featuring a receiver configurable to store a refrigerant fluid, an evaporator configurable to extract heat from a heat load when the heat load contacts the evaporator, an exhaust line that exhausts refrigerant vapor from the evaporator and which does not return the exhausted refrigerant vapor to the receiver, a control device configurable to control a vapor quality of the refrigerant fluid at an outlet of the evaporator, with the receiver, the evaporator, and the exhaust line coupled to form a refrigerant fluid flow path, and a phase separator positioned downstream from the evaporator and configurable to receive refrigerant fluid emerging from the evaporator, and direct liquid refrigerant into an auxiliary flow path that bypasses the exhaust line.

Some of the features that can be included in the above aspect can be one or more or a combination of the following features.

The phase separator can be configurable to direct refrigerant fluid vapor toward the exhaust line. The system can include a conduit that forms the auxiliary flow path, where an outlet of the conduit through which the liquid refrigerant fluid is discharged is connected to a location along the refrigerant fluid flow path upstream from the evaporator.

The control device can be a first control device, and the system can include a second control device configurable to control a temperature of the heat load. The phase separator can be positioned upstream from the second control device.

Embodiments of the system can also include any of the other features disclosed herein, including any combinations of individual features discussed in connection with different embodiments, except where expressly stated otherwise.

DETAILED DESCRIPTION

I. General Introduction

Cooling of high heat flux loads that are also highly temperature sensitive can present a number of challenges. On one hand, such loads generate significant quantities of heat that is extracted during cooling. In conventional closed-cycle refrigeration systems, cooling high heat flux loads typically involves circulating refrigerant fluid at a relatively high mass flow rate. However, closed-cycle system components that are used for refrigerant fluid circulation—including compressors and condensers—are typically heavy and consume significant power. As a result, many closed-cycle systems are not well suited for deployment in mobile platforms—such as on small vehicles—where size and weight constraints may make the use of large compressors and condensers impractical.

On the other hand, temperature sensitive loads such as electronic components and devices may require temperature regulation within a relatively narrow range of operating temperatures. Maintaining the temperature of such a load to within a small tolerance of a temperature set point can be challenging when a single-phase refrigerant fluid is used for heat extraction, since the refrigerant fluid itself will increase in temperature as heat is absorbed from the load.

Directed energy systems that are mounted to mobile vehicles such as trucks may present many of the foregoing operating challenges, as such systems may include high heat flux, temperature sensitive components that require precise cooling during operation in a relatively short time. The thermal management systems disclosed herein, while generally applicable to the cooling of a wide variety of thermal loads, are particularly well suited for operation with such directed energy systems.

In particular, the thermal management systems and methods disclosed herein include a number of features that reduce both overall size and weight relative to conventional refrigeration systems, and still extract excess heat energy from both high heat flux, highly temperature sensitive components and relatively temperature insensitive components, to accurately match temperature set points for the components. At the same time the disclosed thermal management systems require no significant power to sustain their operation. Whereas certain conventional refrigeration systems used closed-circuit refrigerant flow paths, the systems and methods disclosed herein use open-cycle refrigerant flow paths. Depending upon the nature of the refrigerant fluid, exhaust refrigerant fluid may be incinerated as fuel, chemically treated, and/or simply discharged at the end of the flow path.

II. Thermal Management Systems with Open Circuit Refrigeration Systems

Figure 1:
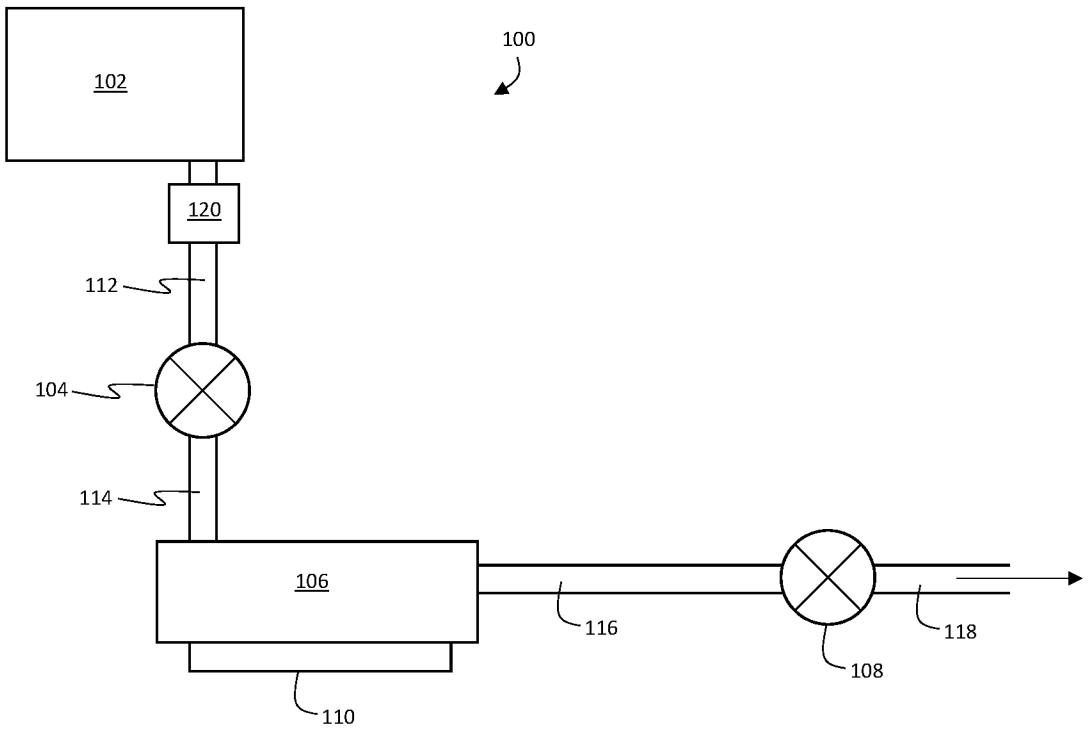
FIG. 1 is a schematic diagram of an example of a thermal management system that includes an open circuit refrigeration system.

FIG. 1 is a schematic diagram of an example of a thermal management system 100 that includes an open circuit refrigeration system. System 100 includes a receiver 102, an optional valve 120, a first control device 104, an evaporator 106, a second control device 108, and conduits 112, 114, 116, and 118. A heat load 110 (load 110 or heat load 110 or thermal load 110 used interchangeably herein) is coupled to evaporator 106.

Figure 2:
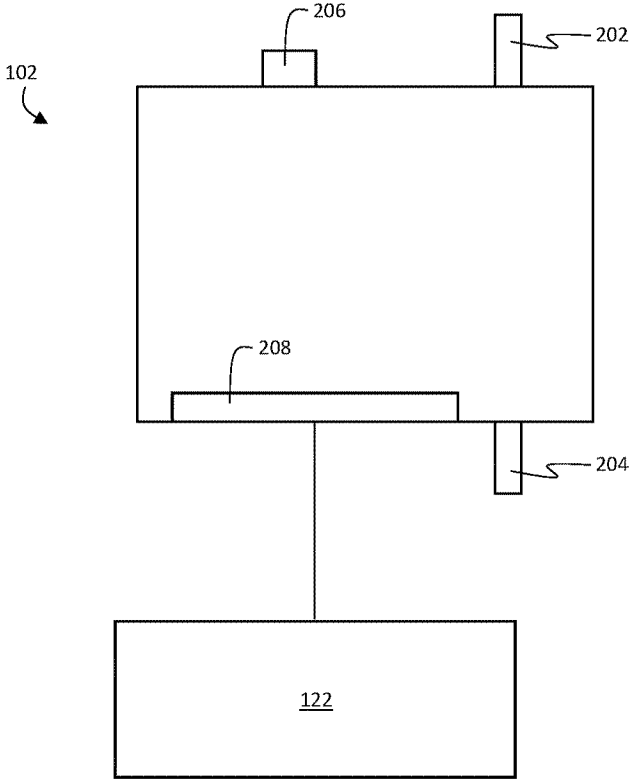
FIG. 2 is a schematic diagram of an example of a receiver for refrigerant fluid in a thermal management system.

Receiver 102 is typically implemented as an insulated vessel that stores a refrigerant fluid at relatively high pressure. FIG. 2 shows a schematic diagram of an example of a receiver 102. Receiver 102 includes an inlet port 202, an outlet port 204, a pressure relief valve 206, and a heater 208. Heater 208 is connected via a control line to controller 122. To charge receiver 102, refrigerant fluid is typically introduced into receiver 102 via inlet port 202, and this can be done, for example, at service locations. Operating in the field the refrigerant exits receiver 102 through output port 204 which is connected to conduit 112 (FIG. 1). In case of emergency, if the fluid pressure within receiver 102 exceeds a pressure limit value, pressure relief valve 206 opens to allow a portion of the refrigerant fluid to escape through valve 206 to reduce the fluid pressure within receiver 102. When ambient temperature is very low and, as a result, pressure in the receiver is low and insufficient to drive refrigerant fluid flow through the system, heat may be applied to evaporate a portion of the liquid refrigerant in the receiver and thus elevate the refrigerant vapor pressure in the receiver. Heater 208, which can be implemented as a resistive heating element (e.g., a strip heater) or any of a wide variety of different types of heating elements, can be activated by controller 122 to heat the refrigerant fluid within receiver 102. Receiver 102 can also include insulation (not shown in FIG. 2) applied around the receiver and the heater to reduce thermal losses.

In general, receiver 102 can have a variety of different shapes. In some embodiments, for example, the receiver is cylindrical. Examples of other possible shapes include, but are not limited to, rectangular prismatic, cubic, and conical. In certain embodiments, receiver 102 can be oriented such that outlet port 204 is positioned at the bottom of the receiver. In this manner, the liquid portion of the refrigerant fluid within receiver 102 is discharged first through outlet port 204, prior to discharge of refrigerant vapor.

Returning to FIG. 1, first control device 104 functions as a flow control device. In general, first control device 104 can be implemented as any one or more of a variety of different mechanical and/or electronic devices. For example, in some embodiments, first control device 104 can be implemented as a fixed orifice, a capillary tube, and/or a mechanical or electronic expansion valve. In general, fixed orifices and capillary tubes are passive flow restriction elements which do not actively regulate refrigerant fluid flow.

Mechanical expansion valves (usually called thermostatic or thermal expansion valves) are typically flow control devices that enthalpically expand a refrigerant fluid from a first pressure to an evaporating pressure, controlling the superheat at the evaporator exit. Mechanical expansion valves generally include an orifice, a moving seat that changes the cross-sectional area of the orifice and the refrigerant fluid volume and mass flow rates, a diaphragm moving the seat, and a bulb at the evaporator exit. The bulb is charged with a fluid and it hermetically fluidly communicates with a chamber above the diaphragm. The bulb senses the refrigerant fluid temperature at the evaporator exit (or another location) and the pressure of the fluid inside the bulb, transfers the pressure in the bulb through the chamber to the diaphragm, and moves the diaphragm and the seat to close or to open the orifice.

Typical electrical expansion valves include an orifice, a moving seat, a motor or actuator that changes the position of the seat with respect to the orifice, a controller, and pressure and temperature sensors at the evaporator exit. The controller calculates the superheat for the expanded refrigerant fluid based on pressure and temperature measurements at the evaporator exit. If the superheat is above a set-point value, the seat moves to increase the cross-sectional area and the refrigerant fluid volume and mass flow rates to match the superheat set-point value. If the superheat is below the set-point value the seat moves to decrease the cross-sectional area and the refrigerant fluid flow rates.

Examples of suitable commercially available expansion valves that can function as first control device 104 include, but are not limited to, thermostatic expansion valves available from the Sporlan Division of Parker Hannifin Corporation (Washington, MO) and from Danfoss (Syddanmark, Denmark).

Evaporator 106 can be implemented in a variety of ways. In general, evaporator 106 functions as a heat exchanger, providing thermal contact between the refrigerant fluid and heat load 110. Typically, evaporator 106 includes one or more flow channels extending internally between an inlet and an outlet of the evaporator, allowing refrigerant fluid to flow through the evaporator and absorb heat from heat load 110.

A variety of different evaporators can be used in system 100. In general, any cold plate may function as the evaporator of the open circuit refrigeration systems disclosed herein. Evaporator 106 can accommodate any refrigerant fluid channels (including mini/micro-channel tubes), blocks of printed circuit heat exchanging structures, or more generally, any heat exchanging structures that are used to transport single-phase or two-phase fluids. The evaporator and/or components thereof, such as fluid transport channels, can be attached to the heat load mechanically, or can be welded, brazed, or bonded to the heat load in any manner.

Figure 3A:
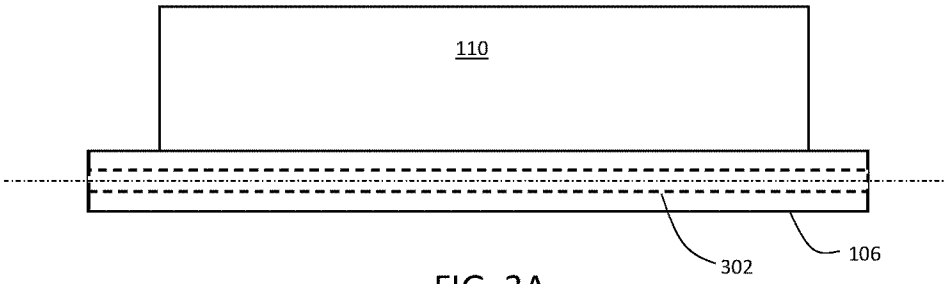
FIGS. 3A and 3B are schematic diagrams showing side and end views, respectively, of an example of a thermal load that includes refrigerant fluid channels.
Figure 3B:
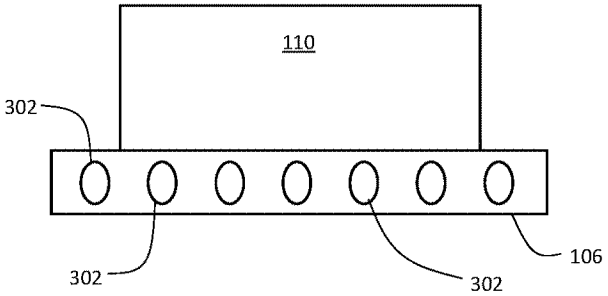

In some embodiments, evaporator 106 (or certain components thereof) can be fabricated as part of heat load 110 or otherwise integrated into heat load 110. FIGS. 3A and 3B show side and end views, respectively, of a heat load 110 with one or more integrated refrigerant fluid channels 302. The portion of head lead 110 with the refrigerant fluid channel(s) 302 effectively functions as the evaporator 106 for the system.

Returning to FIG. 1, second control device 108 generally functions to control the fluid pressure upstream of the regulator. In system 100, second control device 108 controls the refrigerant fluid pressure upstream from the evaporator 106 and second control device 108. In general, second control device 108 can be implemented using a variety of different mechanical and electronic devices. Typically, for example, second control device 108 can be implemented as a flow regulation device, such as a back pressure regulator.

A back pressure regulator (BPR) is a device that regulates fluid pressure upstream from the regulator.

In general, a wide range of different mechanical and electrical/electronic devices can be used as second control device 108. Typically, mechanical back pressure regulating devices have an orifice and a spring supporting the moving seat against the pressure of the refrigerant fluid stream. The moving seat adjusts the cross-sectional area of the orifice and the refrigerant fluid volume and mass flow rates.

Typical electrical back pressure regulating devices include an orifice, a moving seat, a motor or actuator that changes the position of the seat in respect to the orifice, a controller, and a pressure sensor at the evaporator exit or at the valve inlet. If the refrigerant fluid pressure is above a set-point value, the seat moves to increase the cross-sectional area of the orifice and the refrigerant fluid volume and mass flow rates to re-establish the set-point pressure value. If the refrigerant fluid pressure is below the set-point value, the seat moves to decrease the cross-sectional area and the refrigerant fluid flow rates.

In general, back pressure regulators are selected based on the refrigerant fluid volume flow rate, the pressure differential across the regulator, and the pressure and temperature at the regulator inlet. Examples of suitable commercially available back pressure regulators that can function as second control device 108 include, but are not limited to, valves available from the Sporlan Division of Parker Hannifin Corporation (Washington, MO) and from Danfoss (Syddanmark, Denmark).

A variety of different refrigerant fluids can be used in system 100. For open circuit refrigeration systems in general, emissions regulations and operating environments may limit the types of refrigerant fluids that can be used. For example, in certain embodiments, the refrigerant fluid can be ammonia having very large latent heat; after passing through the cooling circuit, the ammonia refrigerant can be disposed of by incineration, by chemical treatment (i.e., neutralization), and/or by direct venting to the atmosphere.

In certain embodiments, the refrigerant fluid can be an ammonia-based mixture that includes ammonia and one or more other substances. For example, mixtures can include one or more additives that facilitate ammonia absorption or ammonia burning.

More generally, any fluid can be used as a refrigerant in the open circuit refrigeration systems disclosed herein, provided that the fluid is suitable for cooling heat load 110 (e.g., the fluid boils at an appropriate temperature) and, in embodiments where the refrigerant fluid is exhausted directly to the environment, regulations and other safety and operating considerations do not inhibit such discharge.

During operation of system 100, cooling can be initiated by a variety of different mechanisms. In some embodiments, for example, system 100 includes a temperature sensor attached to load 110 (as will be discussed subsequently). When the temperature of load 110 exceeds a certain temperature set point (i.e., threshold value), a controller connected to the temperature sensor can initiate cooling of load 110.

Alternatively, in certain embodiments, system 100 operates essentially continuously—provided that the refrigerant fluid pressure within receiver 102 is sufficient—to cool load 110. As soon as receiver 102 is charged with refrigerant fluid, refrigerant fluid is ready to be directed into evaporator 106 to cool load 110. In general, cooling is initiated when a user of the system or the heat load issues a cooling demand.

Upon initiation of a cooling operation, refrigerant fluid from receiver 102 is discharged from outlet 204, through optional valve 120 if present, and is transported through conduit 112 to first control device 104, which directly or indirectly controls vapor quality at the evaporator outlet. In the following discussion, first control device 104 is implemented as an expansion valve. However, it should be understood that more generally, first control device 104 can be implemented as any component or device that performs the functional steps described below and provides for vapor quality control at the evaporator outlet.

Once inside the expansion valve, the refrigerant fluid undergoes constant enthalpy expansion from an initial pressure $p_r$ (i.e., the refrigerant fluid pressure) to an evaporation pressure $p_e$ at the outlet of the expansion valve. In general, the evaporation pressure $p_e$ depends on a variety of factors, most notably the desired temperature set point value (i.e., the target temperature) at which load 110 is to be maintained and the heat input generated by the load 110.

The initial pressure in the receiver tends to be in equilibrium with the surrounding temperature and is different for different refrigerants. The pressure in the evaporator depends on the evaporating temperature, which is lower than the heat load temperature and is defined during design of the system. The system is operational as long as the receiver-to-evaporator pressure difference is sufficient to drive adequate refrigerant fluid flow through the expansion valve.

After undergoing constant enthalpy expansion in the expansion valve, the liquid refrigerant fluid is converted to a mixture of liquid and vapor phases at the temperature of the fluid and evaporation pressure pc. The two-phase refrigerant fluid mixture is transported via conduit 114 to evaporator 106.

When the two-phase mixture of refrigerant fluid is directed into evaporator 106, the liquid phase absorbs heat from load 110, driving a phase transition of the liquid refrigerant fluid into the vapor phase. Because this phase transition occurs at (nominally) constant temperature, the temperature of the refrigerant fluid mixture within evaporator 106 remains unchanged, provided at least some liquid refrigerant fluid remains in evaporator 106 to absorb heat.

Further, the constant temperature of the refrigerant fluid mixture within evaporator 106 can be controlled by adjusting the pressure $p_e$ of the refrigerant fluid, since adjustment of $p_e$ changes the boiling temperature of the refrigerant fluid. Thus, by regulating the refrigerant fluid pressure $p_e$ upstream from evaporator 106 (e.g., using second control device 108), the temperature of the refrigerant fluid within evaporator 106 (and, nominally, the temperature of heat load 110) can be controlled to match a specific temperature set-point value for load 110, ensuring that load 110 is maintained at, or very near, a target temperature.

The pressure drop across the evaporator causes drop of the temperature of the refrigerant mixture (which is the evaporating temperature), but still the evaporator can be configured to maintain the heat load temperature within in the set tolerances.

In some embodiments, for example, the evaporation pressure of the refrigerant fluid can be adjusted by second control device 108 to ensure that the temperature of thermal load 110 is maintained to within ±5 degrees C. (e.g., to within ±4 degrees C., to within ±3 degrees C., to within ±2 degrees C., to within ±1 degree C.) of the temperature set point value for load 110.

As discussed above, within evaporator 106, a portion of the liquid refrigerant in the two-phase refrigerant fluid mixture is converted to refrigerant vapor by undergoing a phase change. As a result, the refrigerant fluid mixture that emerges from evaporator 106 has a higher vapor quality (i.e., the fraction of the vapor phase that exists in refrigerant fluid mixture) than the refrigerant fluid mixture that enters evaporator 106.

As the refrigerant fluid mixture emerges from evaporator 106, a portion of the refrigerant fluid can optionally be used to cool one or more additional thermal loads. Typically, for example, the refrigerant fluid that emerges from evaporator 106 is nearly in the vapor phase. The refrigerant fluid vapor (or, more precisely, high vapor quality fluid vapor) can be directed into a heat exchanger coupled to another thermal load, and can absorb heat from the additional thermal load during propagation through the heat exchanger. Examples of systems in which the refrigerant fluid emerging from evaporator 106 is used to cool additional thermal loads will be discussed in more detail subsequently.

The refrigerant fluid emerging from evaporator 106 is transported through conduit 116 to second control device 108, which directly or indirectly controls the upstream pressure, that is, the evaporating pressure $p_e$ in the system. After passing through second control device 108, the refrigerant fluid is discharged as exhaust through conduit 118, which functions as an exhaust line for system 100. Refrigerant fluid discharge can occur directly into the environment surrounding system 100. Alternatively, in some embodiments, the refrigerant fluid can be further processed; various features and aspects of such processing are discussed in further detail below.

It should be noted that the foregoing steps, while discussed sequentially for purposes of clarity, occur simultaneously and continuously during cooling operations. In other words, refrigerant fluid is continuously being discharged from receiver 102, undergoing continuous expansion in first control device 104, flowing continuously through evaporator 106 and second control device 108, and being discharged from system 100, while thermal load 110 is being cooled.

During operation of system 100, as refrigerant fluid is drawn from receiver 102 and used to cool thermal load 110, the receiver pressure $p_r$ falls. If the refrigerant fluid pressure $p_r$ (i.e., the initial refrigerant pressure) in receiver 102 is reduced to a value that is too low, the pressure differential $p_r - p_e$ may not be adequate to drive sufficient refrigerant fluid mass flow to provide adequate cooling of thermal load 110. Accordingly, when the refrigerant fluid pressure $p_r$ in receiver 102 is reduced to a value that is sufficiently low, the capacity of system 100 to maintain a particular temperature set point value for load 110 may be compromised. Therefore, the pressure in the receiver or pressure drop across the expansion valve (or any related refrigerant fluid pressure or pressure drop in system 100) can be an indicator of the remaining operational time. An appropriate warning signal can be issued (e.g., by a system controller) to indicate that in a certain period of time, the system may no longer be able to maintain adequate cooling performance; operation of the system can even be halted if the refrigerant fluid pressure in receiver 102 reaches the low-end threshold value.

It should be noted that while in FIG. 1 only a single receiver 102 is shown, in some embodiments, system 100 can include multiple receivers to allow for operation of the system over an extended time period. Each of the multiple receivers can supply refrigerant fluid to the system to extend to total operating time period. Some embodiments may include a plurality of evaporators connected in parallel, which may or may not accompanied by a plurality of expansion valves and plurality of evaporators.

III. System Operational Control

As discussed in the previous section, by adjusting the pressure $p_e$ of the refrigerant fluid, the temperature at which the liquid refrigerant phase undergoes vaporization within evaporator 106 can be controlled. Thus, in general, the temperature of heat load 110 can be controlled by a device or component of system 100 that regulates the pressure of the refrigerant fluid within evaporator 106. Typically, second control device 108 (which can be implemented as a back pressure regulator) adjusts the upstream refrigerant fluid pressure in system 100. Accordingly, second control device 108 is generally configured to control the temperature of heat load 110, and can be adjusted to selectively change a temperature set point value (i.e., a target temperature) for heat load 110.

Another important system operating parameter is the vapor quality of the refrigerant fluid emerging from evaporator 106. The vapor quality, which is a number from 0 to 1, represents the fraction of the refrigerant fluid that is in the vapor phase. Because heat absorbed from load 110 is used to drive a constant-temperature evaporation of liquid refrigerant to form refrigerant vapor in evaporator 106, it is generally important to ensure that, for a particular volume of refrigerant fluid propagating through evaporator 106, at least some of the refrigerant fluid remains in liquid form right up to the point at which the exit aperture of evaporator 106 is reached to allow continued heat absorption from load 110 without causing a temperature increase of the refrigerant fluid. If the fluid is fully converted to the vapor phase after propagating only partially through evaporator 106, further heat absorption by the (now vapor-phase) refrigerant fluid within evaporator 106 will lead to a temperature increase of the refrigerant fluid and heat load 110.

On the other hand, liquid-phase refrigerant fluid that emerges from evaporator 106 represents unused heat-absorbing capacity, in that the liquid refrigerant fluid did not absorb sufficient heat from load 110 to undergo a phase change. To ensure that system 100 operates efficiently, the amount of unused heat-absorbing capacity should remain relatively small.

The evaporator 106 may be configured to maintain exit vapor quality below the critical vapor quality defined as "1." Vapor quality is the ratio of mass of vapor to mass of liquid+vapor and is generally kept in a range of approximately 0.5 to almost 1.0; more specifically 0.6 to 0.95; more specifically 0.75 to 0.9 more specifically 0.8 to 0.9 or more specifically about 0.8 to 0.85. "Vapor quality" thus when defined as mass of vapor/total mass (vapor+liquid), in this sense, the vapor quality cannot exceed "1" or be equal to a value less than "0."

In practice, vapor quality may be expressed as an "equilibrium thermodynamic quality" that is calculated as follows:

$$X=(h-h')/(h''-h'),$$

where h—is any one of specific enthalpy, specific entropy or specific volume, '—means saturated liquid and "—means saturated vapor. In this case X can be mathematically below 0 or above 1, unless the calculation process is forced to operate differently. Either approach is acceptable.

In addition, the boiling heat transfer coefficient that characterizes the effectiveness of heat transfer from load 110 to the refrigerant fluid is typically very sensitive to vapor quality. When the vapor quality increases from zero to a certain value, called a critical vapor quality, the heat transfer coefficient increases. When the vapor quality exceeds the critical vapor quality, the heat transfer coefficient is abruptly reduced to a very low value, causing dryout within evaporator 106. In this region of operation, the two-phase mixture behaves as superheated vapor.

In general, the critical vapor quality and heat transfer coefficient values vary widely for different refrigerant fluids, and heat and mass fluxes. For all such refrigerant fluids and operating conditions, the systems and methods disclosed herein control the vapor quality at the outlet of the evaporator such that the vapor quality approaches the threshold of the critical vapor quality.

To make maximum use of the heat-absorbing capacity of the two-phase refrigerant fluid mixture, the vapor quality of the refrigerant fluid emerging from evaporator 106 should nominally be equal to the critical vapor quality. Accordingly, to both efficiently use the heat-absorbing capacity of the two-phase refrigerant fluid mixture and also ensure that the temperature of heat load 110 remains approximately constant at the phase transition temperature of the refrigerant fluid in evaporator 106, the systems and methods disclosed herein are generally configured to adjust the vapor quality of the refrigerant fluid emerging from evaporator 106 to a value that is less than or equal to the critical vapor quality.

Another important operating consideration for system 100 is the mass flow rate of refrigerant fluid within the system. Evaporator 106 can be configured to provide minimal mass flow rate controlling maximal vapor quality, which is the critical vapor quality. By minimizing the mass flow rate of the refrigerant fluid according to the cooling requirements for heat load 110, system 100 operates efficiently. Each reduction in the mass flow rate of the refrigerant fluid (while maintaining the same temperature set point value for heat load 110) means that the charge of refrigerant fluid added to reservoir 102 initially lasts longer, providing further operating time for system 100.

Within evaporator 106, the vapor quality of a given quantity of refrigerant fluid varies from the evaporator inlet (where vapor quality is lowest) to the evaporator outlet (where vapor quality is highest). Nonetheless, to realize the lowest possible mass flow rate of the refrigerant fluid within the system, the effective vapor quality of the refrigerant fluid within evaporator 106—even when accounting for variations that occur within evaporator 106—should match the critical vapor quality as closely as possible.

In summary, to ensure that the system operates efficiently and the mass flow rate of the refrigerant fluid is relatively low, and at the same time the temperature of heat load 110 is maintained within a relatively small tolerance, system 100 adjusts the vapor quality of the refrigerant fluid emerging from evaporator 106 to a value such that an effective vapor quality within evaporator 106 matches, or nearly matches, the critical vapor quality.

In system 100, first control device 104 is generally configured to control the vapor quality of the refrigerant fluid emerging from evaporator 106. As an example, when first control device 104 is implemented as an expansion valve, the expansion valve regulates the mass flow rate of the refrigerant fluid through the valve. In turn, for a given set of operating conditions (e.g., ambient temperature, initial pressure in the receiver, temperature set point value for heat load 110, heat load 110), the vapor quality determines mass flow rate of the refrigerant fluid emerging from evaporator 106.

First control device 104 typically controls the vapor quality of the refrigerant fluid emerging from evaporator 106 in response to information about at least one thermodynamic quantity that is either directly or indirectly related to the vapor quality. Second control device 108 typically adjusts the temperature of heat load 110 (via upstream refrigerant fluid pressure adjustments) in response to information about at least one thermodynamic quantity that is directly or indirectly related to the temperature of heat load 110. The one or more thermodynamic quantities upon which adjustment of first control device 104 is based are different from the one or more thermodynamic quantities upon which adjustment of second control device 108 is based.

In general, a wide variety of different measurement and control strategies can be implemented in system 100 to achieve the control objectives discussed above. Generally, first control device 104 is connected to a first measurement device and second control device 108 is connected to a second measurement device. The first and second measurement devices provide information about the thermodynamic quantities upon which adjustments of the first and second control devices are based. The first and second measurement devices can be implemented in many different ways, depending upon the nature of the first and second control devices.

Figure 4:
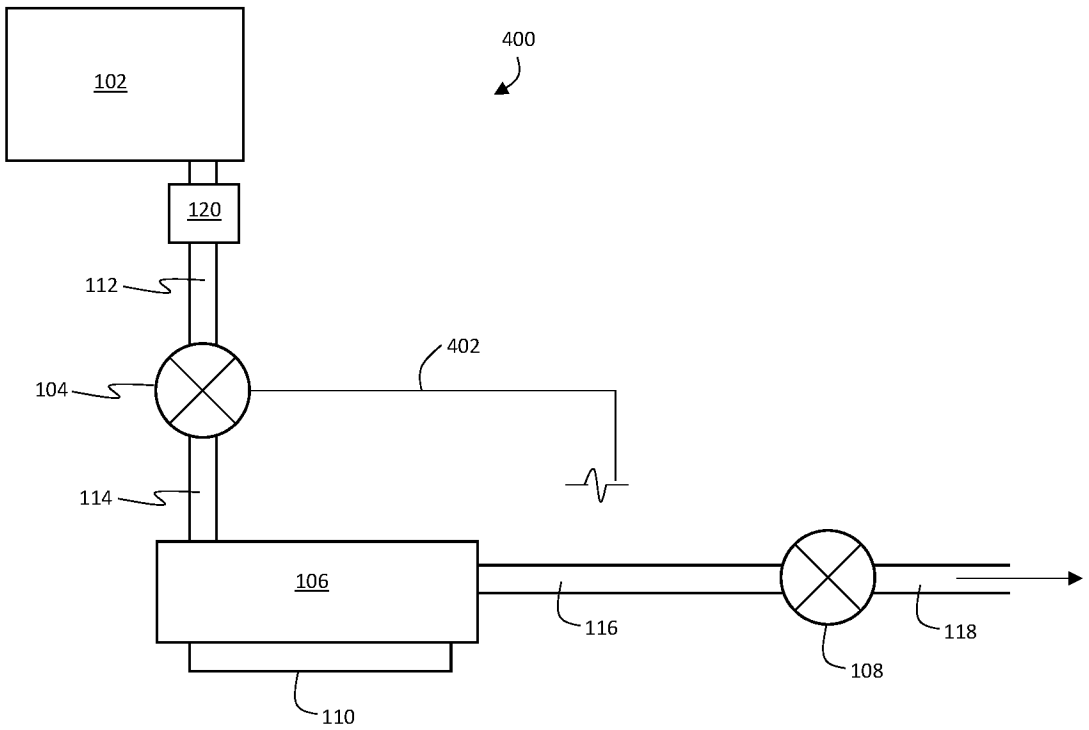
FIG. 4 is a schematic diagram of an example of a thermal management system that optionally includes a mechanically-regulated first control device and optionally includes a mechanically-regulated second control device.

As an example, FIG. 4 shows an embodiment of a thermal management system 400 that optionally includes a first control device 104 implemented as a mechanical expansion valve. First control device 104 is connected to a first measurement device 402 that is used to convey a signal to an actuation assembly within the mechanical expansion valve to adjust the diameter of the orifice in the mechanical expansion valve. The first measurement device 402 can be implemented in various ways. In some embodiments, for example, first measurement device 402 includes a pressure-sensing bulb connected to a member such as an arm. Typically, the pressure-sensing bulb is positioned after a second heat load (which will be discussed in more detail subsequently) in the system and deforms mechanically in response to changes in in-line pressure of the refrigerant fluid following the second heat load. In this respect, the bulb is responsive to changes in superheat of the refrigerant fluid downstream from the second heat load.

The member, coupled to the pressure-sensing bulb, also moves in response to changes in superheat of the refrigerant fluid. The other end of the mechanical member is typically connected to an actuation assembly in the mechanical expansion valve. The actuation assembly includes, for example, a movable diaphragm that adjusts the orifice diameter within the valve. As the pressure-sensing bulb deforms in response to changes in superheat of the refrigerant fluid downstream from the second heat load, the mechanical deformation is coupled through the member to the diaphragm, which moves in concert to adjust the orifice diameter. In this manner, fully automated, responsive control of the mechanical expansion valve is achieved based on changes in superheat of the refrigerant fluid.

As shown in FIG. 4, second control device 108 can also be optionally implemented as a mechanical back pressure regulator. In general, mechanical back pressure regulators that are suitable for use in the systems disclosed herein include an inlet, an outlet, and an adjustable internal orifice (not shown in FIG. 4). To regulate the internal orifice, the mechanical back pressure regulator senses the in-line pressure of refrigerant fluid entering through the inlet, and adjusts the size of the orifice accordingly to control the flow of refrigerant fluid through the regulator and thus, to regulate the upstream refrigerant fluid pressure in the system.

Mechanical back pressure regulators suitable for use in the systems disclosed herein can generally have a variety of different configurations. Certain back pressure regulators, for example, have a small diameter passageway or conduit in a housing or body of the regulator that admits a small quantity of refrigerant fluid vapor that exerts pressure on an internal mechanism (for example, a spring-coupled valve stem) to adjust the size of the orifice. Effectively, in the above example, the passageway or conduit functions as a measurement device for the mechanical back pressure regulator, and the spring-coupled valve stem functions as an actuation assembly.

It should generally be understood that various control strategies, control devices, and measurement devices can be implemented in a variety of combinations in the systems disclosed herein. Thus, for example, either or both of the first and second control devices can be implemented as mechanical devices, as described above. In addition, systems with mixed control devices in which one of the first or second control devices is a mechanical device and the other control device is implemented as an electronically-adjustable device can also be implemented, along with systems in which both the first and second control devices are electronically-adjustable devices that are controlled in response to signals measured by one or more sensors.

Figure 5:
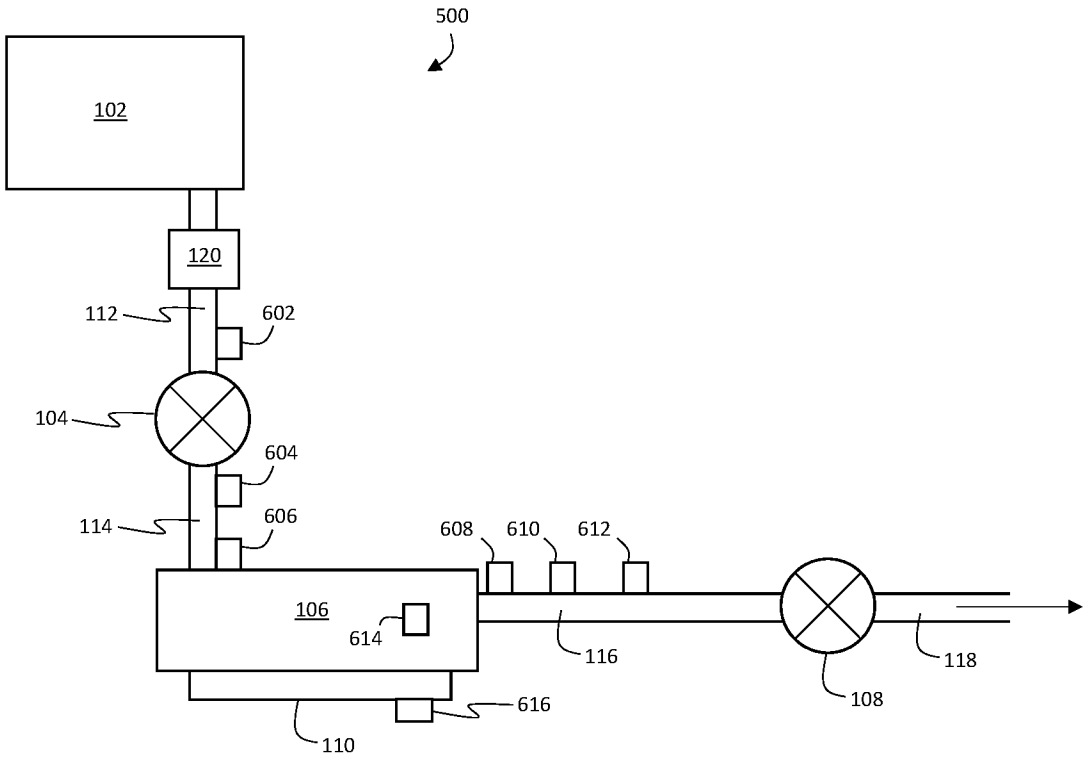
FIG. 5 is a schematic diagram of an example of a thermal management system that includes one or more sensors for measuring system properties.

In some embodiments, the systems disclosed herein can include measurement devices featuring one or more system sensors and/or measurement devices that measure various system properties and operating parameters, and transmit electrical signals corresponding to the measured information. FIG. 5 shows a thermal management system 500 that includes a number of different sensors. Each of the sensors shown in system 500 is optional, and various combinations of the sensors shown in system 500 is used to measure signals that are used to adjust first control device 104 and/or second control device 108.

Shown in FIG. 5 are optional pressure sensors 602 and 604 upstream and downstream from first control device 104, respectively. Pressure sensors 602 and 604 are configured to measure information about the pressure differential $p_r - p_e$ across first control device 104, and to transmit an electronic signal corresponding to the measured pressure difference information. Pressure sensors 602 effectively measures $p_r$, while pressure sensor 604 effectively measures $p_e$. While separate pressure sensors 602 and 604 are shown in FIG. 5, in certain embodiments pressure sensors 602 and 604 are replaced by a single pressure differential sensor. Where a pressure differential sensor is used, a first end of the sensor is connected upstream of first control device 104 and a second end of the sensor is connected downstream from first control device 104.

System 500 also includes optional pressure sensors 606 and 608 positioned at the inlet and outlet, respectively, of evaporator 106. Pressure sensor 606 measures and transmits information about the refrigerant fluid pressure upstream from evaporator 106, and pressure sensor 608 measures and transmits information about the refrigerant fluid pressure downstream from evaporator 106. This information is used (e.g., by a system controller) to calculate the refrigerant fluid pressure drop across evaporator 106.

As above, in certain embodiments, pressure sensors 606 and 608 are replaced by a single pressure differential sensor, a first end of which is connected adjacent to the evaporator inlet and a second end of which is connected adjacent to the evaporator outlet. The pressure differential sensor measures and transmits information about the refrigerant fluid pressure drop across evaporator 106.

To measure the evaporating pressure ($p_e$), sensor 608 is optionally positioned between the inlet and outlet of evaporator 106, i.e., internal to evaporator 106. In such a configuration, sensor 608 can provide a direct a direct measurement of the evaporating pressure.

To measure refrigerant fluid pressure at other locations within system 500, sensor 608 can also optionally be positioned at a location different from the one shown in FIG. 5. For example, sensor 608 is located in-line along conduit 116. Alternatively, sensor 608 is positioned at or near an inlet of second control device 108. Pressure sensors at each of these locations is used to provide information about the refrigerant fluid pressure downstream from evaporator 106, or the pressure drop across evaporator 106.

System 500 includes an optional temperature sensor 614 which is positioned adjacent to an inlet or an outlet of evaporator 106, or between the inlet and the outlet. Sensor 614 measures temperature information for the refrigerant fluid within evaporator 106 (which represents the evaporating temperature) and transmits an electronic signal corresponding to the measured information. System 500 also includes an optional temperature sensor 616 attached to heat load 110, which measures temperature information for the load and transmits an electronic signal corresponding to the measured information.

System 500 includes an optional temperature sensor 610 adjacent to the outlet of evaporator 106 that measures and transmits information about the temperature of the refrigerant fluid as it emerges from evaporator 106.

In certain embodiments, the systems disclosed herein are configured to determine superheat information for the refrigerant fluid based on temperature and pressure information for the refrigerant fluid measured by any of the sensors disclosed herein. The superheat of the refrigerant vapor refers to the difference between the temperature of the refrigerant fluid vapor at a measurement point in the system and the saturated vapor temperature of the refrigerant fluid defined by the refrigerant pressure at the measurement point in the system.

To determine the superheat associated with the refrigerant fluid, a system controller (as will be described in greater detail subsequently) receives information about the refrigerant fluid vapor pressure after emerging from a heat exchanger downstream from evaporator 106, and uses calibration information, a lookup table, a mathematical relationship, or other information to determine the saturated vapor temperature for the refrigerant fluid from the pressure information. The controller also receives information about the actual temperature of the refrigerant fluid, and then calculates the superheat associated with the refrigerant fluid as the difference between the actual temperature of the refrigerant fluid and the saturated vapor temperature for the refrigerant fluid.

The foregoing temperature sensors can be implemented in a variety of ways in system 500. As one example, thermocouples and thermistors can function as temperature sensors in system 500. Examples of suitable commercially available temperature sensors for use in system 500 include, but are not limited to the 88000 series thermocouple surface probes (available from OMEGA Engineering Inc., Norwalk, CT).

System 500 includes a vapor quality sensor 612 that measures vapor quality of the refrigerant fluid emerging from evaporator 106. Typically, sensor 612 is implemented as a capacitive sensor that measures a difference in capacitance between the liquid and vapor phases of the refrigerant fluid. The capacitance information is used to directly determine the vapor quality of the refrigerant fluid (e.g., by a system controller). Alternatively, sensor 612 can determine the vapor quality directly based on the differential capacitance measurements and transmit an electronic signal that includes information about the refrigerant fluid vapor quality. Examples of commercially available vapor quality sensors that is used in system 600 include, but are not limited to HBX sensors (available from HB Products, Hasselager, Denmark).

It should be appreciated that in the foregoing discussion, any one or various combinations of two sensors discussed in connection with system 500 can correspond to the first measurement device connected to first control device 104, and any one or various combination of two sensors can correspond to a second measurement device connected to second control device 108. In general, as discussed previously, the first measurement device provides information corresponding to a first thermodynamic quantity to the first control device, and the second measurement device provides information corresponding to a second thermodynamic quantity to the second control device, where the first and second thermodynamic quantities are different, and therefore allow the first and second control device to independently control two different system properties (e.g., the vapor quality of the refrigerant fluid and the heat load temperature, respectively).

In some embodiments, one or more of the sensors shown in system 500 are connected directly to first control device 104 and/or to second control device 108. The first and second control device is configured to adaptively respond directly to the transmitted signals from the sensors, thereby providing for automatic adjustment of the system's operating parameters. In certain embodiments, the first and/or second control device can include processing hardware and/or software components that receive transmitted signals from the sensors, optionally perform computational operations, and activate elements of the first and/or second control device to adjust the control device in response to the sensor signals.

Figure 6:
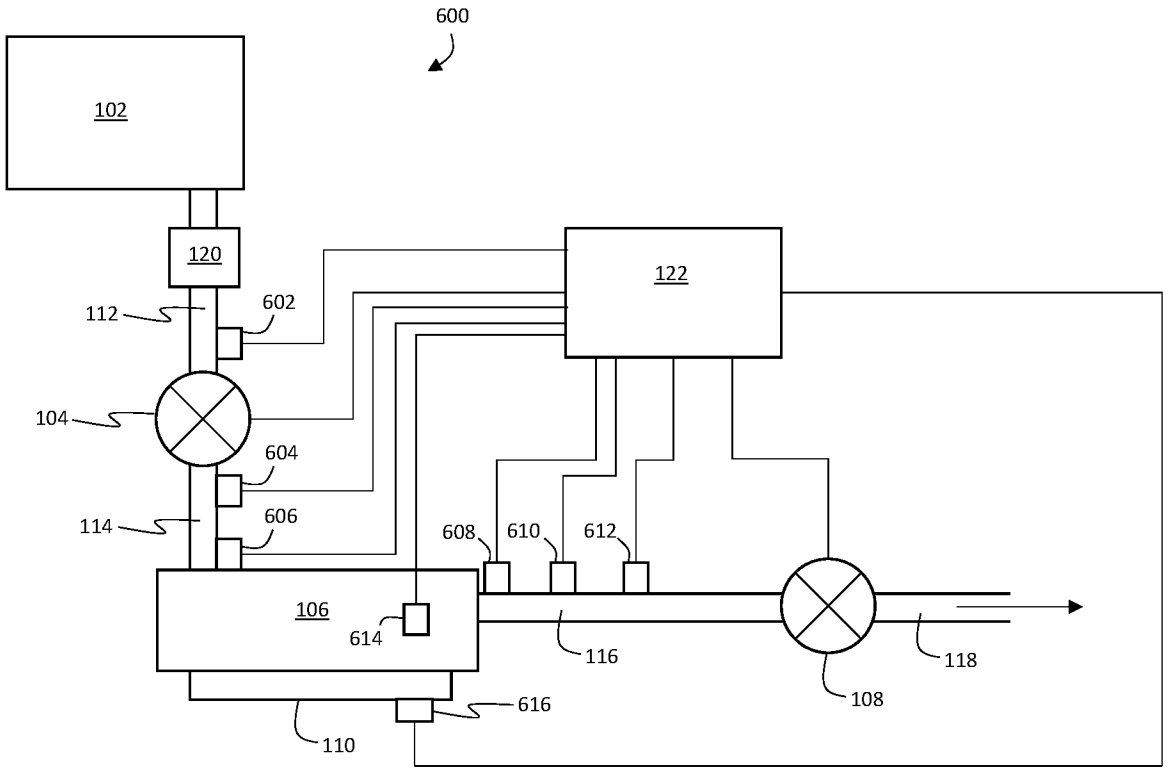
FIG. 6 is a schematic diagram of an example of a thermal management system that includes one or more sensors connected to a controller.

In some embodiments, the systems disclosed herein include a system controller that receives measurement signals from one or more system sensors and transmits control signals to the first and/or second measurement device to independently adjust the refrigerant fluid vapor quality and the heat load temperature. FIG. 6 shows a thermal management system 600 that includes a system controller 122 connected to one or more of the optional sensors 602-616 discussed above, and configured to receive measurement signals from each of the connected sensors. In FIG. 6, connections are shown between each of the sensors 602-616 and the system controller 122 for illustrative purposes. In many embodiments, however, thermal management system 600 includes only certain combinations of the sensors shown in FIG. 6 (e.g., one, two, three, or four of the sensors) to provide suitable control signals for the first and/or second control device.

In addition, controller 122 is optionally connected to first control device 104 and second control device 108. In embodiments where either first control device 104 or second control device 108 (or both) is/are implemented as a device controllable via an electrical control signal, controller 122 is configured to transmit suitable control signals to the first and/or second control device to adjust the configuration of these components. In particular, controller 122 is optionally configured to adjust first control device 104 to control the vapor quality of the refrigerant fluid in system 600, and optionally configured to adjust second control device 108 to control the temperature of heat load 110.

During operation of system 600, controller 122 typically receives measurement signals from one or more sensors. The measurements can be received periodically (e.g., at consistent, recurring intervals) or irregularly, depending upon the nature of the measurements and the manner in which the measurement information is used by controller 122. In some embodiments, certain measurements are performed by controller 122 after particular conditions—such as a measured parameter value exceeding or falling below an associated set point value—are reached.

It should generally understood that the systems disclosed herein can include a variety of combinations of the various sensors described above, and controller 122 can receive measurement information periodically or aperiodically from any of the various sensors. Moreover, it should be understood any of the sensors described can operate autonomously, measuring information and transmitting the information to controller 122 (or directly to the first and/or second control device), or alternatively, any of the sensors described above can measure information when activated by controller 122 via a suitable control signal, and measure and transmit information to controller 122 in response to the activating control signal.

By way of example, Table 1 summarizes various examples of combinations of types of information (e.g., system properties and thermodynamic quantities) that is measured by the sensors of system 600 and transmitted to controller 122, to allow controller 122 to generate and transmit suitable control signals to first control device 104 and/or second control device 108. The types of information shown in Table 1 can generally be measured using any suitable device (including combination of one or more of the sensors discussed herein) to provide measurement information to controller 122.

TABLE 1

| | | Measurement Information Used to Adjust First Control Device | | | | | | | |
|---|---|---|---|---|---|---|---|---|---|
| | | FCM Press Drop | Evap Press Drop | Rec Pres | VQ | SH | Evap VQ | Evap P/T | HL Temp |
| Measurement Information Used to Adjust Second Control Device | FCM Press Drop | | | | | | | x | x |
| | Evap Press Drop | | | | | | | x | x |
| | Rec Press | | | | | | | x | x |
| | VQ | | | | | | | x | x |
| | SH | | | | | | | x | x |
| | Evap VQ | | | | | | | x | x |
| | Evap P/T | x | x | x | x | x | x | | x |
| | HL Temp | x | x | x | x | x | x | x | |

FCM Press Drop = refrigerant fluid pressure drop across first control device
Evap Press Drop = refrigerant fluid pressure drop across evaporator
Rec Press = refrigerant fluid pressure in receiver
VQ = vapor quality of refrigerant fluid
SH = superheat of refrigerant fluid
Evap VQ = vapor quality of refrigerant fluid at evaporator outlet
Evap P/T = evaporation pressure or temperature
HL Temp = heat load temperature For example, in some embodiments, first control device 104 is adjusted (e.g., automatically or by controller 122)

based on a measurement of the evaporation pressure ($p_e$) of the refrigerant fluid and/or a measurement of the evaporation temperature of the refrigerant fluid. With first control device 104 adjusted in this manner, second control device 108 is adjusted (e.g., automatically or by controller 122) based on measurements of one or more of the following system parameter values: the pressure drop across first control device 104, the pressure drop across evaporator 106, the refrigerant fluid pressure in receiver 102, the vapor quality of the refrigerant fluid emerging from evaporator 106 (or at another location in the system), the superheat value of the refrigerant fluid, and the temperature of thermal load 110.

In certain embodiments, first control device 104 is adjusted (e.g., automatically or by controller 122) based on a measurement of the temperature of thermal load 110. With first control device 104 adjusted in this manner, second control device 108 is adjusted (e.g., automatically or by controller 122) based on measurements of one or more of the following system parameter values: the pressure drop across first control device 104, the pressure drop across evaporator 106, the refrigerant fluid pressure in receiver 102, the vapor quality of the refrigerant fluid emerging from evaporator 106 (or at another location in the system), the superheat value of the refrigerant fluid, and the evaporation pressure ($p_e$) and/or evaporation temperature of the refrigerant fluid.

In some embodiments, system controller 122 adjusts second control device 108 based on a measurement of the evaporation pressure $p_e$ of the refrigerant fluid downstream from first control device 104 (e.g., measured by pressure sensors 604 or 606) and/or a measurement of the evaporation temperature of the refrigerant fluid (e.g., measured by temperature sensor 614). With second control device 108 adjusted based on this measurement, system controller 122 can adjust first control device 104 based on measurements of one or more of the following system parameter values: the pressure drop ($p_r$–$p_e$) across first control device 104, the pressure drop across evaporator 106, the refrigerant fluid pressure in receiver 102 ($p_r$), the vapor quality of the refrigerant fluid emerging from evaporator 106 (or at another location in the system), the superheat value of the refrigerant fluid in the system, and the temperature of thermal load 110.

In certain embodiments, controller 122 adjusts second control device 108 based on a measurement of the temperature of thermal load 110 (e.g., measured by sensor 124). Controller 122 can also adjust first control device 104 based on measurements of one or more of the following system parameter values: the pressure drop ($p_r$–$p_e$) across first control device 104, the pressure drop across evaporator 106, the refrigerant fluid pressure in receiver 102 ($p_r$), the vapor quality of the refrigerant fluid emerging from evaporator 106 (or at another location in the system), the superheat value of the refrigerant fluid in the system, the evaporation pressure ($p_e$) of the refrigerant fluid, and the evaporation temperature of the refrigerant fluid.

To adjust either first control device 104 or second control device 108 based on a particular value of a measured system parameter value, controller 122 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 122 adjusts first control device 104 and/or second control device 108 to adjust the operating state of the system, and reduce the system parameter value.

Certain set point values represent a minimum allowable value of a system parameter, and if the measured value is equal to the set point value (or differs from the set point value by 10% or less (e.g., 5% or less, 3% or less, 1% or less) of the set point value), controller 122 adjusts first control device 104 and/or second control device 108 to adjust the operating state of the system, and increase the system parameter value.

Some set point values represent "target" values of system parameters. For such system parameters, if the measured parameter value differs from the set point value by 1% or more (e.g., 3% or more, 5% or more, 10% or more, 20% or more), controller 122 adjusts first control device 104 and/or second control device 108 to adjust the operating state of the system, so that the system parameter value more closely matches the set point value.

In the foregoing examples, measured parameter values are assessed in relative terms based on set point values (i.e., as a percentage of set point values). Alternatively, in some embodiments, measured parameter values can be assessed in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then controller 122 adjusts first control device 104 and/or second control device 108 to adjust the operating state of the system, so that the measured system parameter value more closely matches the set point value.

Figure 8:
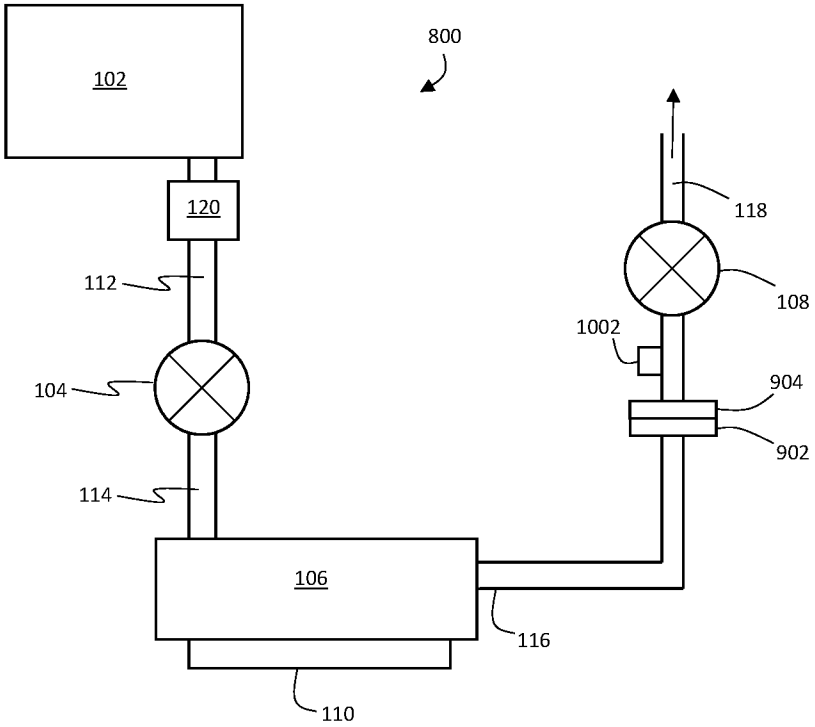
FIG. 8 is a schematic diagram of another example of a thermal management system that includes an evaporator for extracting heat energy from a first thermal load and a heat exchanger for extracting heat energy from a second thermal load.
Figure 7:
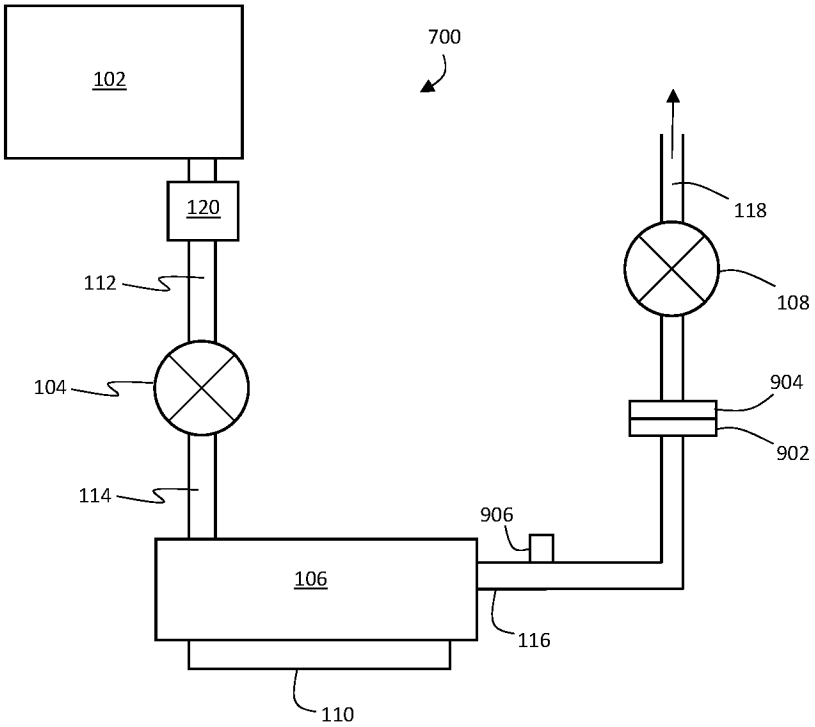
FIG. 7 is a schematic diagram of an example of a thermal management system that includes an evaporator for extracting heat energy from a first thermal load and a heat exchanger for extracting heat energy from a second thermal load.

In certain embodiments, refrigerant fluid emerging from evaporator 106 is used to cool one or more additional thermal loads. FIGS. 7 and 8 show thermal management systems 700 and 800 that include many of the features discussed previously. In addition, systems 700 and 800 include a second thermal load 904 connected to a heat exchanger 902. A variety of mechanical connections can be used to attach second thermal load 904 to heat exchanger 902, including (but not limited to) brazing, clamping, welding, and any of the other connection types discussed herein.

Heat exchanger 902 includes one or more flow channels through which high vapor quality refrigerant fluid flows after leaving evaporator 106. During operation, as the refrigerant fluid vapor passes through the flow channels, it absorbs heat energy from second thermal load 904, cooling second thermal load 904. Typically, second thermal load 904 is not as sensitive as thermal load 110 to fluctuations in temperature. Accordingly, while second thermal load 904 is generally not cooled as precisely relative to a particular temperature set point value as thermal load 110, the refrigerant fluid vapor provides cooling that adequately matches the temperature constraints for second thermal load 904.

Although in FIGS. 7 and 8 only one additional thermal load (i.e., second thermal load 904) is shown, in general the systems disclosed herein can include more than one (e.g., two or more, three or more, four or more, five or more, or even more) thermal loads in addition to thermal load 904. Each of the additional thermal loads can have an associated heat exchanger; in some embodiments, multiple additional thermal loads are connected to a single heat exchanger, and in certain embodiments, each additional thermal load has its own heat exchanger. Moreover, each of the additional thermal loads is cooled by the superheated refrigerant fluid vapor after a heat exchanger attached to the second load or cooled by the high vapor quality fluid stream that emerges from evaporator 106.

Although evaporator 106 and heat exchanger 902 are implemented as separate components in FIGS. 7 and 8, in certain embodiments, these components are integrated to form a single heat exchanger, with thermal load 110 and second thermal load 904 both connected to the single heat exchanger. The refrigerant fluid vapor that is discharged from the evaporator portion of the single heat exchanger is used to cool second thermal load 904, which is connected to a second portion of the single heat exchanger.

In FIGS. 7 and 8, the vapor quality of the refrigerant fluid after passing through evaporator 106 is controlled either directly or indirectly with respect to a vapor quality set point by controller 122. In some embodiments, as shown in FIG. 7, the system includes a vapor quality sensor 906 that provides a direct measurement of vapor quality which is transmitted to controller 122. Controller 122 adjusts first control device 104 to control the vapor quality relative to the vapor quality set point value.

In certain embodiments, as shown in FIG. 8, the system includes a sensor 1002 that measures superheat, and indirectly, vapor quality. For example, in FIG. 8, sensor 1002 is a combination of temperature and pressure sensors that measures the refrigerant fluid superheat downstream from the second heat load 904, and transmits the measurements to controller 122. Controller 122 adjusts first control device 104 based on the measured superheat relative to a superheat set point value. By doing so, controller 122 indirectly adjusts the vapor quality of the refrigerant fluid emerging from evaporator 106.

In some embodiments, controller 122 can adjust second control device 108 based on measurements of the superheat value of the refrigerant fluid vapor that are performed downstream from a second thermal load that is cooled by the superheated refrigerant fluid vapor.

Although heat exchanger 902 and second heat load 904 are positioned upstream from second control device 108 in FIGS. 7 and 8, in some embodiments, heat exchanger 902 and second heat load 904 is positioned downstream from second control device 108. Positioning heat exchanger 902 and second thermal load 904 downstream from second control device 108 can have certain advantages. Depending upon the system's various operating parameter settings, refrigerant fluid emerging from evaporator 106 can include some liquid refrigerant which may not effectively cool second thermal load 904. Prior to entering heat exchanger 902, however, the refrigerant fluid is converted entirely to the vapor phase in second control device 108, so that the refrigerant fluid entering heat exchanger 902 consists entirely of refrigerant vapor.

Further, in some embodiments, sensor 1002 is positioned downstream from second control device 108. As discussed above, measured superheat information is used to adjust first control device 104 (e.g., to indirectly control vapor quality at the outlet of evaporator 106).

Figure 9:
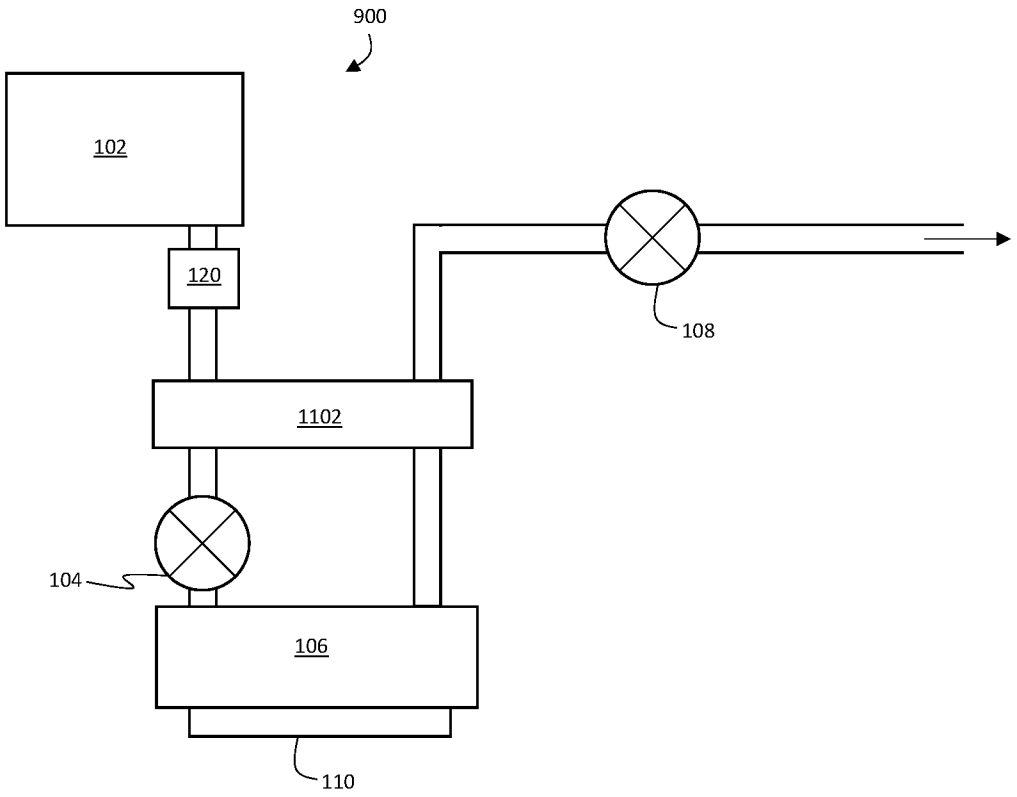
FIG. 9 is a schematic diagram of an example of a thermal management system that includes a recuperative heat exchanger.

In certain embodiments, the thermal management systems disclosed herein can include a recuperative heat exchanger for transferring heat energy from the refrigerant fluid emerging from evaporator 106 to refrigerant fluid upstream from first control device 104. FIG. 9 is a schematic diagram of a thermal management system 900 that includes many of the features discussed previously. In addition, system 900 includes a recuperative heat exchanger 1102. Recuperative heat exchanger 1102 includes a first flow path for refrigerant fluid flowing from receiver 102 to first control device 104, and a second flow path for refrigerant fluid flowing in a counterpropagating direction from evaporator 106. The recuperative heat exchanger is useful when there is no second heat load in system 900 or when all heat loads are cooled by the evaporator(s) only.

As the two refrigerant fluid streams flow in opposite directions within recuperative heat exchanger 1102, heat is transferred from the refrigerant fluid emerging from evaporator 106 to the refrigerant fluid entering first control device 104. Heat transfer between the refrigerant fluid streams can have a number of advantages. For example, recuperative heat transfer can increase the refrigeration effect in evaporator 106, thereby reducing the refrigerant mass transfer rate implemented to handle the heat load presented by thermal load 110. Further, by reducing the refrigerant mass transfer rate through evaporator 106, the amount of refrigerant used to provide cooling duty in a given period of time is reduced. As a result, for a given initial quantity of refrigerant fluid introduced into receiver 102, the operational time over which the system can operate before an additional refrigerant fluid charge is needed can be extended. Alternatively, for the system to effectively cool thermal load 110 for a given period of time, a smaller initial charge of refrigerant fluid into receiver 102 can be used.

Figure 10:
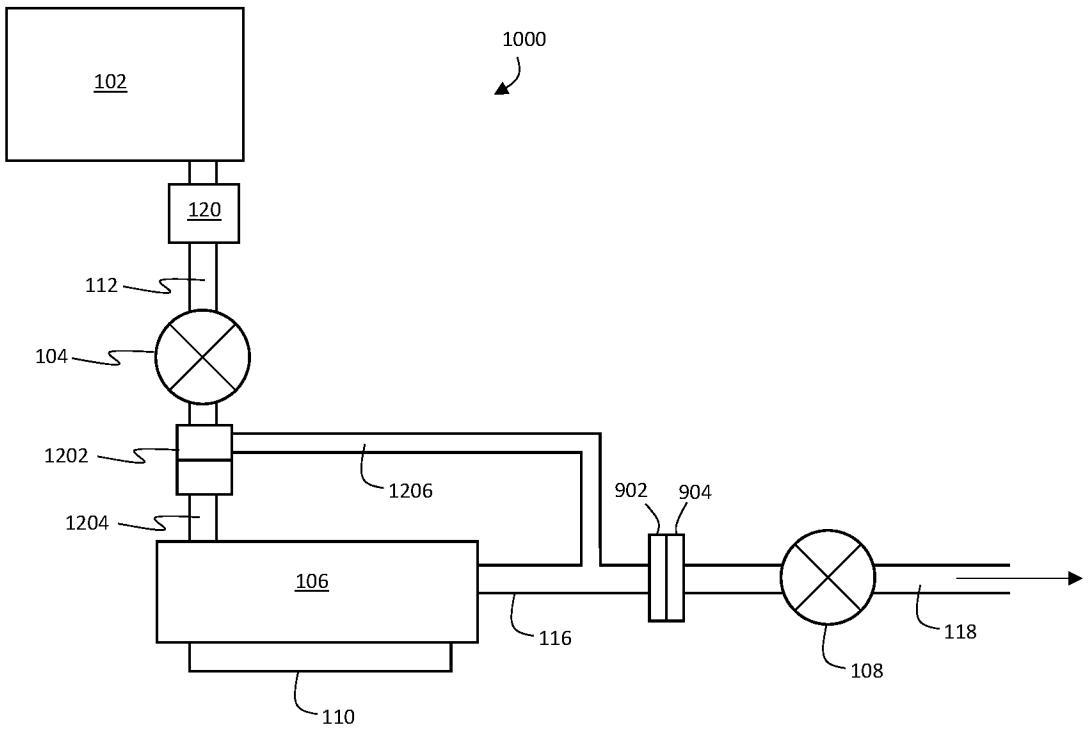
FIG. 10 is a schematic diagram of an example of a thermal management system that includes a refrigerant fluid phase separator.

Because the liquid and vapor phases of the two-phase mixture of refrigerant fluid generated following expansion of the refrigerant fluid in first control device 104 is used for different cooling applications, in some embodiments, the system can include a phase separator to separate the liquid and vapor phases into separate refrigerant streams that follow different flow paths within the system. FIG. 10 shows an example of a thermal management system 1000 that includes many features that are similar to those discussed previously. In addition, system 1000 also includes a phase separator 1202 that separates the refrigerant fluid stream emerging from first control device 104 into a vapor phase, which is directed into conduit 1206, and a liquid phase, which is directed into conduit 1204. The liquid phase enters evaporator 106 and is used to cool thermal load 110, as discussed above. The vapor phase is combined with the refrigerant fluid emerging from evaporator 106 and directed into heat exchanger 902, where it is used to cool second thermal load 904 if the second thermal load exists.

Because the liquid phase of the refrigerant fluid is more dense than the vapor phase, phase separator 1202 can separate the two refrigerant phases by gravitational action, drawing off the vapor phase near the top of the phase separator and the liquid phase near the bottom of the phase separator as shown in FIG. 10.

Separating the liquid and vapor phases into two different refrigerant fluid streams can have a number of advantages. For example, by directing a nearly vapor-free liquid refrigerant fluid into the inlet of evaporator 106, the fluid channels within the evaporator can have smaller cross-sectional areas than fluid channels that carry a mixture of liquid and vapor phases of the refrigerant fluid. By reducing the cross-sectional areas of the fluid channels, the overall system weight is reduced.

Further, eliminating (or nearly eliminating) the refrigerant vapor from the refrigerant fluid stream entering evaporator 106 can help to reduce the cross-section of the evaporator and improve film boiling in the refrigerant channels. In film boiling, the liquid phase (in the form of a film) is physically separated from the walls of the refrigerant channels by a layer of refrigerant vapor, leading to poor thermal contact and heat transfer between the refrigerant liquid and the refrigerant channels. Reducing film boiling improves the efficiency of heat transfer and the cooling performance of evaporator 106.

In addition, by eliminating (or nearly eliminating) the refrigerant vapor from the refrigerant fluid stream entering evaporator 106, distribution of the liquid refrigerant within the channels of evaporator 106 is made easier. In certain embodiments, vapor present in the refrigerant channels of evaporator 106 can oppose the flow of liquid refrigerant into the channels. Diverting the vapor phase of the refrigerant fluid before the fluid enters evaporator 106 can help to reduce this difficulty.

In addition to phase separator 1202, or as an alternative to phase separator 1202, in some embodiments the systems disclosed herein can include a phase separator downstream from evaporator 106. Such a configuration is used when the refrigerant fluid emerging from evaporator is not entirely in the vapor phase, and still includes liquid refrigerant fluid.

Figure 11:
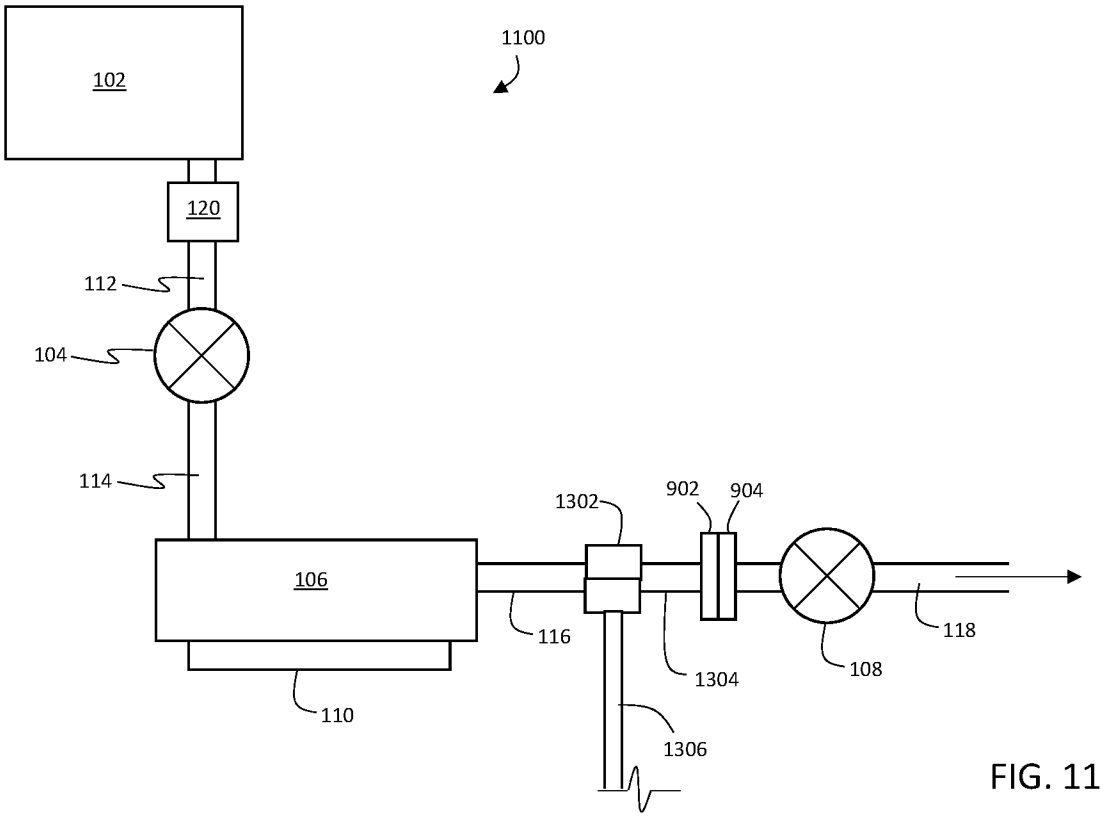
FIG. 11 is a schematic diagram of another example of a thermal management system that includes a refrigerant fluid phase separator.

FIG. 11 shows an example of a thermal management system 1100 that includes many features that are similar to those discussed previously. In addition, system 1100 also includes a phase separator 1302 downstream from evaporator 106. Phase separator 1302 receives the refrigerant fluid (a mixture of liquid and vapor phases) from evaporator 106 through conduit 116 and separates the phases. Liquid refrigerant fluid is directed through conduit 1306 and is reintroduced, for example, into conduit 114, upstream from evaporator 106, so it is used to cool heat load 110. Refrigerant fluid vapor is transported through conduit 1304 and into heat exchanger 902, where it is used to cool second heat load 904 (if it exists).

IV. Additional Features of Thermal Management Systems

The foregoing examples of thermal management systems illustrate a number of features that is included in any of the systems within the scope of this disclosure. In addition, a variety of other features is present in such systems.

In certain embodiments, refrigerant fluid that is discharged from evaporator 106 and passes through conduit 116 and second control device 108 is directly discharged as exhaust from conduit 118 without further treatment. Direct discharge provides a convenient and straightforward method for handling spent refrigerant, and has the added advantage that over time, the overall weight of the system is reduced due to the loss of refrigerant fluid. For systems that are mounted to small vehicles or are otherwise mobile, this reduction in weight is important.

In some embodiments, however, refrigerant fluid vapor is further processed before it is discharged. Further processing may be desirable depending upon the nature of the refrigerant fluid that is used, as direct discharge of unprocessed refrigerant fluid vapor may be hazardous to humans and/or may deleterious to mechanical and/or electronic devices in the vicinity of the system. For example, the unprocessed refrigerant fluid vapor may be flammable or toxic, or may corrode metallic device components. In situations such as these, additional processing of the refrigerant fluid vapor may be desirable.

Figure 12A:
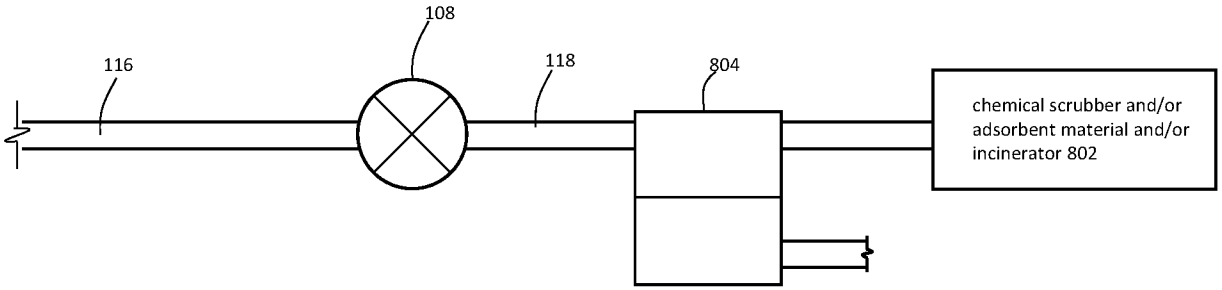
FIGS. 12A and 12B are schematic diagrams showing example portions of thermal management systems that include a refrigerant fluid processing apparatus.
Figure 12B:
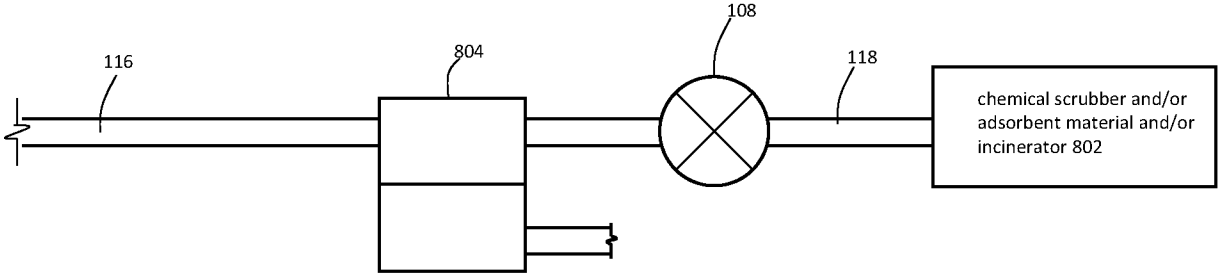

FIGS. 12A and 12B show portions of thermal management systems in which a refrigerant processing apparatus 802 is connected to conduit 118. Spent refrigerant fluid vapor is directed into refrigerant processing apparatus 802 where it is further processed. In general, refrigerant processing apparatus 802 is implemented in various ways. In some embodiments, refrigerant processing apparatus 802 is a chemical scrubber or water-based scrubber. Within refrigerant processing apparatus 802, the refrigerant fluid is exposed to one or more chemical agents that treat the refrigerant fluid vapor to reduce its deleterious properties. For example, where the refrigerant fluid vapor is basic (e.g., ammonia) or acidic, the refrigerant fluid vapor is exposed to one or more chemical agents that neutralize the vapor and yield a less basic or acidic product that is collected for disposal or discharged from refrigerant processing apparatus 802.

As another example, where the refrigerant fluid vapor is highly chemically reactive, the refrigerant fluid vapor is exposed to one or more chemical agents that oxidize, reduce, or otherwise react with the refrigerant fluid vapor to yield a less reactive product that is collected for disposal or discharged from apparatus 802.

In certain embodiments, refrigerant processing apparatus 802 is implemented as an adsorptive sink for the refrigerant fluid. Apparatus 802 can include, for example, an adsorbent material bed that binds particles of the refrigerant fluid vapor, trapping the refrigerant fluid within apparatus 802 and preventing discharge. The adsorptive process can sequester the refrigerant fluid particles within the adsorbent material bed, which can then be removed from apparatus 802 and sent for disposal.

In some embodiments, where the refrigerant fluid is flammable, refrigerant processing apparatus 802 is implemented as an incinerator. Incoming refrigerant fluid vapor is mixed with oxygen or another oxidizing agent and ignited to combust the refrigerant fluid. The combustion products is discharged from the incinerator or collected (e.g., via an adsorbent material bed) for later disposal.

As an alternative, refrigerant processing apparatus 802 can also be implemented as a combustor of an engine or another mechanical power-generating device. Refrigerant fluid vapor from conduit 118 is mixed with oxygen, for example, and combusted in a piston-based engine or turbine to perform mechanical work, such as providing drive power for a vehicle or driving a generator to produce electricity. In certain embodiments, the generated electricity is used to provide electrical operating power for one or more devices, including thermal load 110. For example, thermal load 110 can include one or more electronic devices that are powered, at least in part, by electrical energy generated from combustion of refrigerant fluid vapor in refrigerant processing apparatus 802.

As shown in FIGS. 12A and 12B, the thermal management systems disclosed herein can optionally include a phase separator 804 upstream from the refrigerant processing apparatus 802. In FIG. 12A, phase separator 804 is also downstream from second control device 108, while in FIG. 12B, separator 804 is upstream from second control device 108. Phase separator 804 is present in addition to, or as an alternative to, phase separator 1202 and/or phase separator 1302.

Particularly during start-up of the systems disclosed herein, liquid refrigerant may be present in conduits 116 and/or 118, because the systems generally begin operation before heat load 110 and/or heat load 904 are activated. Accordingly, phase separator 804 functions in a manner similar to phase separators 1202 and 1302 described above, to separate liquid refrigerant fluid from refrigerant vapor. The separated liquid refrigerant fluid is re-directed to another portion of the system, or retained within phase separator 804 until it is converted to refrigerant vapor. By using phase separator 804, liquid refrigerant fluid is prevented from entering refrigerant processing apparatus 802.

V. Integration with Power Systems

Figure 13:
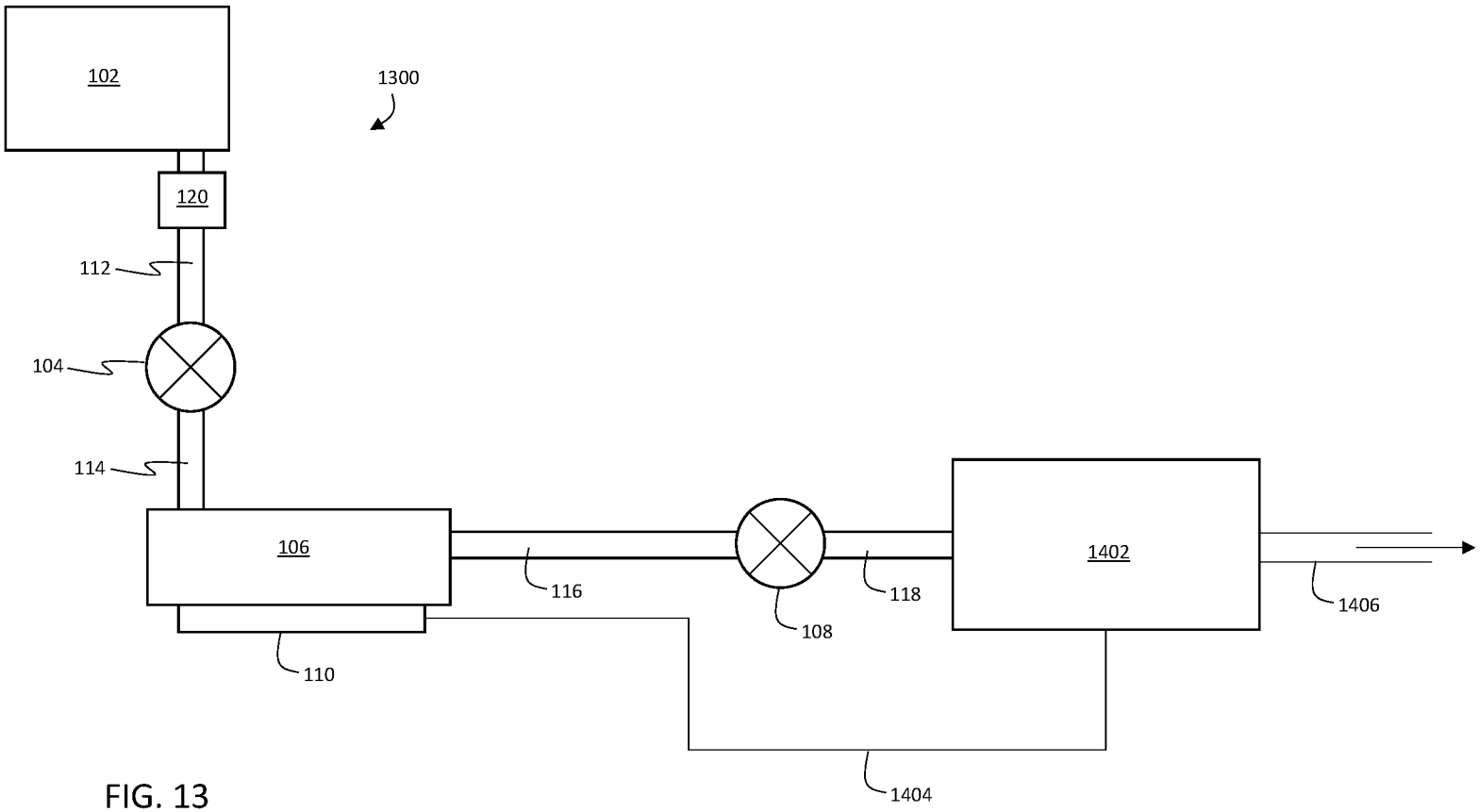
FIG. 13 is a schematic diagram of an example of a thermal management system that includes a power generation apparatus.

In some embodiments, the refrigeration systems disclosed herein can combined with power systems to form integrated power and thermal systems, in which certain components of the integrated systems are responsible for providing refrigeration functions and certain components of the integrated systems are responsible for generating operating power. FIG. 13 shows an integrated power and thermal management system 1300 that includes many features similar to those discussed above. In addition, system 1300 includes an engine 1402 with an inlet that receives the stream of waste refrigerant fluid that enters conduit 118 after passing through second control device 108. Engine 1402 can combust the waste refrigerant fluid directly, or alternatively, can mix the waste refrigerant fluid with one or more additives (such as oxidizers) before combustion. Where ammonia is used as the refrigerant fluid in system 1300, suitable engine configurations for both direct ammonia combustion as fuel, and combustion of ammonia mixed with other additives, can be implemented. In general, combustion of ammonia improves the efficiency of power generation by the engine.

The energy released from combustion of the refrigerant fluid can be used by engine 1402 to generate electrical power, e.g., by using the energy to drive a generator. The electrical power is delivered via electrical connection 1404 to thermal load 110 to provide operating power for the load. For example, in certain embodiments, thermal load 110 includes one or more electrical circuits and/or electronic devices, and engine 1402 provides operating power to the circuits/devices via combustion of refrigerant fluid. Byproducts of the combustion process is discharged from engine 1402 via exhaust conduit 1406, as shown in FIG. 13.

Various types of engines and power-generating devices are implemented as engine 1402 in system 1400. In some embodiments, for example, engine 1402 is a conventional four cycle piston-based engine, and the waste refrigerant fluid is introduced into a combustor of the engine. In certain embodiments, engine 1402 is a gas turbine engine, and the waste refrigerant fluid is introduced via the engine inlet to the afterburner of the gas turbine engine.

As discussed above in connection with FIGS. 12A and 12B, in some embodiments, system 1300 can include phase separator 804 positioned upstream from engine 1402 and either downstream or upstream from second control device 108. Phase separator 804 functions to prevent liquid refrigerant fluid from entering engine 1402, which may reduce the efficiency of electrical power generation by engine 1402.

VI. Start-Up and Temporary Operation

In certain embodiments, the thermal management systems disclosed herein operate differently at, and immediately following, system start-up, compared to the manner in which the systems operate after an extended running period. Upon start-up, refrigerant fluid in receiver 102 may be relatively cold, and therefore the receiver pressure ($p_r$) may be lower than a typical receiver pressure during extended operation of the system. However, if receiver pressure $p_r$ is too low, the system may be unable to maintain a sufficient mass flow rate of refrigerant fluid through evaporator 106 to adequately cool thermal load 110.

As discussed in connection with FIG. 2, however, receiver 102 can optionally include a heater 208. Heater 208 can generally be implemented as any of a variety of different conventional heaters, including resistive heaters. In addition, heater 208 can correspond to a device or apparatus that transfers some of the enthalpy of the exhaust from engine 1402 into receiver 102, or a device or apparatus that transfers enthalpy from any other heat source into receiver 102.

During operation, controller 122 can activate heater 208 to maintain the temperature of the refrigerant fluid in receiver 102. By maintaining the refrigerant fluid temperature, the vapor pressure of the refrigerant fluid, and also the pressure $p_r$, are maintained such that the refrigerant fluid is delivered to evaporator 106.

Optionally, during cold start-up, system controller 122 activates heater 208 to evaporate portion of the refrigerant fluid in receiver 102 and raise the vapor pressure and refrigerant fluid pressure $p_r$ in receiver. This allows the system to deliver refrigerant fluid into evaporator 106 at a sufficient mass flow rate. As the refrigerant fluid in receiver 102 warms up heater 208 is deactivated by system controller 122. By heating refrigerant fluid within receiver 102 at start-up, the thermal management system can begin to cool thermal load 110 after a relatively short warm-up period. To heat refrigerant fluid in receiver 102, for example, heater 208 can deliver heat that is received from a waste heat source in the system (e.g., heat recirculated from another component in the system) ensuring that relatively little or no power is consumed to generate the heat. In cold weather, the refrigerant fluid can also be pre-heated prior to being introduced into receiver 102.

System controller 122 can also activate heater 208 to re-heat refrigerant fluid in receiver 102 between cooling cycles. Thus, for example, when the thermal management system runs periodically to provide intermittent cooling of thermal load 110, controller 122 can activate heater 208 when the thermal management system is not running to ensure that when thermal management system operation resumes, the receiver pressure $p_r$ in receiver 102 is sufficient to deliver refrigerant fluid to evaporator 106 at the desired mass flow rate almost immediately. During the system operation the heater typically provides heat input at a reduced rate to maintain an acceptable refrigerant fluid pressure in receiver 102. Insulation around receiver 102 can help to reduce heating demands.

VII. Integration with Directed Energy Systems

The thermal management systems and methods disclosed herein can be implemented as part of (or in conjunction with) directed energy systems such as high energy laser systems. Due to their nature, directed energy systems typically present a number of cooling challenges, including certain heat loads for which temperatures are maintained during operation within a relatively narrow range.

Figure 14:
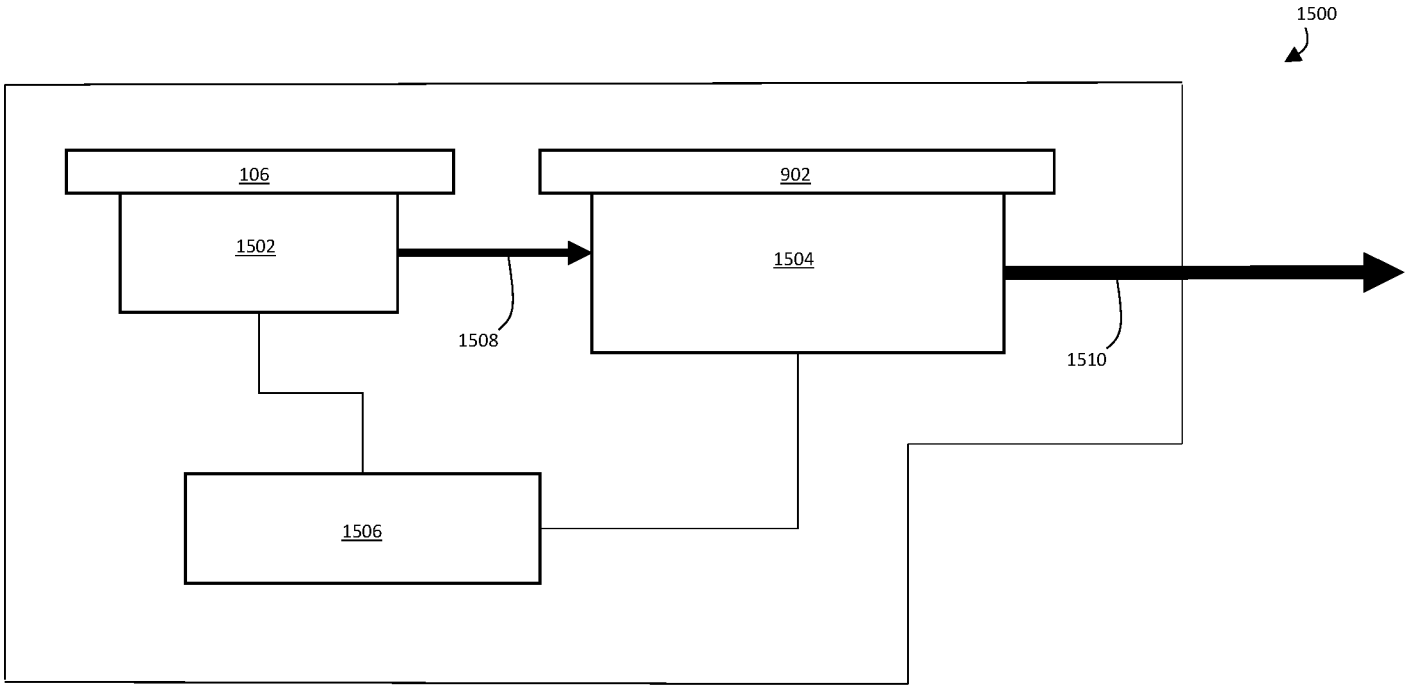
FIG. 14 is a schematic diagram of an example of directed energy system that includes a thermal management system.

FIG. 14 shows one example of a directed energy system, specifically, a high energy laser system 1500. High energy laser system 1500 includes a bank of one or more laser diodes 1502 and an amplifier 1504 connected to a power source 1506. During operation, laser diodes 1502 generate an output radiation beam 1508 that is amplified by amplifier 1504, and directed as output beam 1510 onto a target. Generation of high energy output beams can result in the production of significant quantities of heat. Certain laser diodes, however, are relatively temperature sensitive, and the operating temperature of such laser diodes is regulated within a relatively narrow range of temperatures to ensure efficient operation and avoid thermal damage. Amplifiers are also temperature-sensitively, although typically less sensitive than laser diodes.

To regulate the temperatures of various components of directed energy systems such as laser diodes 1502 and amplifier 1504, such systems can include components and features of the thermal management systems disclosed herein. In FIG. 14, evaporator 106 is coupled to laser diodes 1502, while heat exchanger 902 is coupled to amplifier 1504. The other components of the thermal management systems disclosed herein are not shown for clarity. However, it should be understood that any of the features and components discussed above can optionally be included in directed energy systems. Laser diodes 1502, due to their temperature-sensitive nature, effectively function as heat load 110 in system 1500, while amplifier 1504 functions as heat load 904.

High energy laser system 1500 is one example of a directed energy system that can include various features and components of the thermal management systems and methods described herein. However, it should be appreciated that the thermal management systems and methods are general in nature, and is applied to cool a variety of different heat loads under a wide range of operating conditions.

VIII. Hardware and Software Implementations

Controller 122 can generally be implemented as any one of a variety of different electrical or electronic computing or processing devices, and can perform any combination of the various steps discussed above to control various components of the disclosed thermal management systems.

System controller 122 can generally, and optionally, include any one or more of a processor (or multiple processors), a memory, a storage device, and input/output device. Some or all of these components are interconnected using a system bus. The processor is capable of processing instructions for execution. In some embodiments, the processor is a single-threaded processor. In certain embodiments, the processor is a multi-threaded processor. Typically, the processor is capable of processing instructions stored in the memory or on the storage device to display graphical information for a user interface on the input/output device, and to execute the various monitoring and control functions discussed above. Suitable processors for the systems disclosed herein include both general and special purpose microprocessors, and a sole processor or one of multiple processors for any kind of computer or computing device.

The memory stores information within the system, and is a computer-readable medium, such as a volatile or non-volatile memory. The storage device is capable of providing mass storage for the controller 122. In general, the storage device can include any non-transitory tangible media configured to store computer readable instructions. For example, the storage device can include a computer-readable medium and associated components, including: magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. Processors and memory units of the systems disclosed herein is supplemented by, or incorporated in, ASICs (application-specific integrated circuits).

The input/output device provides input/output operations for controller 122, and can include a keyboard and/or pointing device. In some embodiments, the input/output device includes a display unit for displaying graphical user interfaces and system related information.

The features described herein, including components for performing various measurement, monitoring, control, and communication functions, are implemented in digital electronic circuitry, or in computer hardware, firmware, or in combinations of them. Methods steps is implemented in a computer program product tangibly embodied in an information carrier, e.g., in a machine-readable storage device, for execution by a programmable processor (e.g., of system controller 122), and features are performed by a programmable processor executing such a program of instructions to perform any of the steps and functions described above. Computer programs suitable for execution by one or more system processors include a set of instructions that are used, directly or indirectly, to cause a processor or other computing device executing the instructions to perform certain activities, including the various steps discussed above.

Computer programs suitable for use with the systems and methods disclosed herein is written in any form of programming language, including compiled or interpreted languages, and is deployed in any form, including as standalone programs or as modules, components, subroutines, or other units suitable for use in a computing environment.

In addition to one or more processors and/or computing components implemented as part of controller 122, the systems disclosed herein can include additional processors and/or computing components within any of the control device (e.g., first control device 104 and/or second control device 108) and any of the sensors discussed above. Processors and/or computing components of the control device and sensors, and software programs and instructions that are executed by such processors and/or computing components, can generally have any of the features discussed above in connection with controller 122.

OTHER EMBODIMENTS

A number of embodiments have been described. Nevertheless, it will be understood that various modifications may be made without departing from the spirit and scope of the disclosure. Accordingly, other embodiments are within the scope of the following claims.

What is claimed is:

1. A thermal management system, comprising:

an open circuit refrigeration system comprising:

a receiver configured to store a refrigerant fluid comprising ammonia and including a liquid refrigerant fluid;

an evaporator attached to a heat load and configured to extract heat from the heat load when the heat load contacts the evaporator having an inlet and an outlet;

a vapor quality sensor that produces a sensor signal that is a measure of a vapor quality of the refrigerant fluid emerging from an outlet of the evaporator;

a controller that receives the sensor signal from the vapor quality sensor and produces one or more electrical control signals;

an expansion valve responsive to at least one of the one or more electrical control signals to control the vapor quality of the refrigerant fluid at the outlet of the evaporator with, with the vapor quality being a value of a ratio of mass of vapor to mass of liquid plus vapor, the vapor quality controlled, according to a set point temperature value, and with the expansion valve and the evaporator configured to maintain the vapor quality that emerges from the outlet of the evaporator, so as not to exceed a critical vapor quality defined as one (1), and with the vapor quality further being a value that is less than a value of vapor quality at which dryout occurs in the evaporator;

an exhaust line configured to receive all of the refrigerant fluid emerging from the outlet of the evaporator, with the receiver, the evaporator, the outlet, the expansion valve, and the exhaust line coupled to form a refrigerant fluid flow path, and with all of the refrigerant fluid from the exhaust line discharged so that all of the refrigerant fluid emerging from the outlet of the evaporator is discharged and is not returned to the receiver; and a heat exchanger coupled to the refrigerant fluid flow path, the heat exchanger comprising:

a first fluid path positioned so that liquid refrigerant fluid from the receiver flows through the first fluid path to the expansion valve; and a second fluid path positioned so that refrigerant vapor from the evaporator flows through the second fluid path to transfer heat from the refrigerant vapor in the second fluid path to the liquid refrigerant fluid in the first fluid path.

2. The system of claim 1, the system further comprising:

a flow control device positioned downstream from the evaporator along the refrigerant fluid flow path.

3. The system of claim 2, wherein the flow control device is configured to control a temperature of the heat load.

4. The system of claim 2 wherein the flow control device comprises a back pressure regulator.

5. The system of claim 4, wherein the back pressure regulator is configured to receive refrigerant fluid vapor generated in the evaporator and to regulate refrigerant fluid pressure upstream from the back pressure regulator along the refrigerant fluid flow path.

6. The system of claim 5, wherein the back pressure regulator is further configured to perform an expansion of the refrigerant fluid vapor.

7. The system of claim 1, wherein the expansion valve is configured to:

receive the liquid refrigerant fluid from the receiver at a first pressure;

expand the liquid refrigerant fluid to generate a refrigerant fluid mixture at a second pressure, with the refrigerant fluid mixture comprising the liquid refrigerant fluid and a refrigerant fluid vapor; and direct the refrigerant fluid mixture into the evaporator.

8. The system of claim 1, wherein the expansion valve controls the vapor quality to be in a range of 0.5 to less than 1.0.

9. The system of claim 1 wherein the expansion valve comprises a first actuation assembly that is adjustable based on the one or more electrical control signals, the vapor quality sensor transmits on the one or more electrical control signals to the expansion valve based on a difference in capacitance between liquid and vapor phases of the refrigerant fluid.

10. A thermal management method, comprising:

transporting a liquid refrigerant fluid comprising ammonia from a receiver in a first direction through a heat exchanger attached to a heat load, an expansion valve, an evaporator, and an outlet of the evaporator that is configured to extract heat from the heat load when the heat load contacts the evaporator, and transporting refrigerant vapor fluid from the evaporator through the heat exchanger in a second direction toward an exhaust line configured to receive all refrigerant fluid from the outlet of the evaporator, while transferring heat from the refrigerant vapor fluid transported along the second direction to the liquid refrigerant fluid transported along the first direction;

producing by a vapor quality sensor, a sensor signal that is a measure of a vapor quality of the refrigerant fluid emerging from the outlet of the evaporator;

controlling with the expansion valve the vapor quality, with the vapor quality being a value of a ratio of mass of vapor to mass of liquid plus vapor, with the vapor quality controlled, according to a set point temperature value, and with the expansion valve and the evaporator configured to maintain the vapor quality that emerges from the outlet of the evaporator, so as not to exceed critical vapor quality defined as one (1), and further being a value that is less than a value of vapor quality at which dryout occurs in the evaporator;

receiving, by the exhaust line, all of the refrigerant fluid emerging from the outlet of the evaporator; and discharging all of the refrigerant vapor fluid from the exhaust line so that all of the refrigerant fluid emerging from the outlet of the evaporator is discharged and is not returned to the receiver.

11. The method of claim 10, further comprising:

directing the liquid refrigerant fluid from the receiver at a first pressure into expansion valve;

expanding the liquid refrigerant fluid in the expansion valve to generate a refrigerant fluid mixture at a second pressure, wherein the refrigerant fluid mixture comprises liquid refrigerant fluid and refrigerant fluid vapor; and directing the refrigerant fluid mixture out of the expansion valve and into the evaporator.

12. The method of claim 11, further comprising:

separating the refrigerant fluid mixture generated in the expansion valve into the refrigerant fluid vapor and the liquid refrigerant fluid;

directing at least a portion of the refrigerant fluid vapor along a flow path that bypasses the evaporator; and directing the liquid refrigerant fluid into the evaporator.

13. The method of claim 12, further comprising directing the at least a portion of the refrigerant fluid vapor into the heat exchanger and along the second direction through the heat exchanger.

14. The method of claim 10 further comprising:

after transporting the liquid refrigerant fluid through the evaporator and prior to transporting the refrigerant vapor fluid toward the exhaust line, transporting the refrigerant vapor fluid through a flow control device; and controlling a temperature of the heat load by operation of the flow control device.

15. The method of claim 14, further comprising:

adjusting the flow control device based on a first attribute corresponding to a property of the liquid refrigerant fluid; and adjusting the flow control device based on an attribute corresponding to a property of the heat load.

* * * * *